US008723750B2

(12) United States Patent
Podduturi

(10) Patent No.: US 8,723,750 B2
(45) Date of Patent: May 13, 2014

(54) OPTIMIZED CONFORMAL-TO-METER ANTENNAS

(75) Inventor: Bharadvaj R. Podduturi, Pleasant Hill, CA (US)

(73) Assignee: World Products, Inc., Sonoma, CA (US)

( * ) Notice: Subject to any disclaimer, the term of this patent is extended or adjusted under 35 U.S.C. 154(b) by 581 days.

(21) Appl. No.: 12/881,898

(22) Filed: Sep. 14, 2010

(65) Prior Publication Data

US 2011/0063172 A1 Mar. 17, 2011

Related U.S. Application Data

(60) Provisional application No. 61/276,628, filed on Sep. 14, 2009, provisional application No. 61/277,524, filed on Sep. 25, 2009.

(51) Int. Cl.

| | |
|---|---|
| ***H01Q 9/28*** | (2006.01) |
| ***H01Q 1/24*** | (2006.01) |
| ***H01Q 1/22*** | (2006.01) |

(52) U.S. Cl.
USPC ..... 343/795; 343/702; 343/720

(58) Field of Classification Search
USPC ..... 343/795, 702, 720, 797, 798, 799, 800, 343/810, 893
See application file for complete search history.

(56) References Cited

U.S. PATENT DOCUMENTS

| | | | | |
|---|---|---|---|---|
| 6,239,765 | B1 | 5/2001 | Johnson et al. | |
| 6,975,278 | B2 | 12/2005 | Song et al. | |
| 7,042,412 | B2 * | 5/2006 | Chuang | 343/795 |
| 7,042,415 | B2 | 5/2006 | Cheng | |
| 7,265,718 | B2 | 9/2007 | Tsai | |
| 7,268,737 | B1 * | 9/2007 | Ai et al. | 343/795 |
| 7,486,249 | B2 | 2/2009 | Fujita et al. | |
| 7,518,567 | B2 | 4/2009 | Utagawa et al. | |
| 7,642,967 | B2 | 1/2010 | Wang et al. | |
| 7,688,273 | B2 | 3/2010 | Montgomery et al. | |
| 7,692,600 | B1 | 4/2010 | Pakosz et al. | |
| 2004/0183728 | A1 * | 9/2004 | Zinanti et al. | 343/700 MS |
| 2004/0222936 | A1 | 11/2004 | Hung | |
| 2005/0035919 | A1 | 2/2005 | Yang et al. | |
| 2006/0145923 | A1 | 7/2006 | Autti | |

(Continued)

FOREIGN PATENT DOCUMENTS

| | | | |
|---|---|---|---|
| EP | 1414109 | A2 | 4/2004 |
| EP | 2 62 054 | A1 | 12/2010 |

(Continued)

OTHER PUBLICATIONS

Extended European Search Report for EP Application No. 10776514.1, filed Sep. 14, 2010, mailed Oct. 23, 2012 (13 pgs.).

(Continued)

*Primary Examiner* — Michael C Wimer
*Assistant Examiner* — Patrick Holecek
(74) *Attorney, Agent, or Firm* — Patterson Thuente Pedersen, P.A.

(57) ABSTRACT

A dual-dipole, multi-band conformal antenna for facilitating optimized wireless communications of a utility meter. The antenna includes an antenna backing, the backing adapted to conform to an inside surface of a utility meter and an antenna trace affixed to the antenna backing. The antenna trace is made of a conductive material and includes a symmetric low-band portion and an asymmetric high-band portion.

7 Claims, 26 Drawing Sheets

(56) References Cited

U.S. PATENT DOCUMENTS

| | | | | |
|---|---|---|---|---|
| 2006/0284780 | A1 | 12/2006 | Chen et al. | |
| 2006/0284784 | A1* | 12/2006 | Smith et al. | 343/872 |
| 2008/0068216 | A1 | 3/2008 | Borisov et al. | |
| 2008/0129536 | A1* | 6/2008 | Randall et al. | 340/870.02 |

FOREIGN PATENT DOCUMENTS

| | | | |
|---|---|---|---|
| JP | 2005-117082 | A | 4/2005 |
| JP | 2006-245369 | A | 9/2006 |
| KR | 10-2007-0018511 | A | 2/2007 |

OTHER PUBLICATIONS

International Preliminary Report on Patentability (IPRP) for International Application No. PCT/US2010/048787, filed Sep. 10, 2010, mailed Mar. 29, 2012 (6 pgs.).

Portuguese Office Action for Patent Application No. 2011032153, dated Dec. 28, 2011, issued from the Portuguese Industrial Property Office (INPI) (including English translation) (8 pgs).

Tilley et al., "Dual frequency coplanar strip dipole antenna," Digest of the Antennas and Propagation Society International Symposium. Seattle, WA., Jun. 19-24, 1994, New York, IEEE, US, vol. 2, Jun. 20, 1994 (pp. 928-931).

* cited by examiner

A-A

PRIOR ART

PRIOR ART

PRIOR ART

OPTIMIZED CONFORMAL-TO-METER ANTENNAS

RELATED APPLICATIONS

The present application claims priority to U.S. Provisional Application No. 61/276,628 filed on Sep. 14, 2009 and entitled CONFORMAL TO RADOME ANTENNA, and to U.S. Provisional Application No. 61/277,524 filed on Sep. 25, 2009, and entitled OPTIMIZED CONFORMAL TO METER/RADOME ANTENNAS, both of which are herein incorporated by reference in their entireties.

FIELD OF THE INVENTION

The present invention relates generally to conformal antennas. More particularly, the present invention relates to dual-dipole multiband antennas, conformal to utility-meters.

BACKGROUND OF THE INVENTION

Radio-frequency (RF) antennas used in electrical meters often suffer from performance issues due to the proximity of the antenna to the electrical components of the meter and also due to the size of the meter body, which blinds the field of vision of the antenna. Printed circuit boards, often circular, are located just beneath the face of the meter, adjacent the antenna. The traces and electrical components of the printed circuit board may couple with portions of the antenna, affecting the operating characteristics of the antenna, including peak gain and efficiency. Antenna performance is also degraded considerably by the presence of the current transformers, complex electrical wiring, capacitors, inductors and varistors within the meter's body, which are in close proximity to the antenna.

There have been antennas designed on the dual dipole concept before. However, known dual-dipole antenna designs are still susceptible to interference from the printed circuit boards of the meter. Unacceptable peak gains caused by the interference of the printed circuit board may be reduced, but only at the expense of overall efficiency. This problem is especially true for meters utilizing conformal antennas located adjacent circular printed circuit boards.

SUMMARY OF THE INVENTION

In one embodiment, the present invention includes a dual-dipole, multi-band conformal antenna for facilitating optimized wireless communications of a utility meter. The antenna includes an antenna backing, the backing adapted to conform to an inside surface of a utility meter and an antenna trace affixed to the antenna backing. The antenna trace is made of a conductive material and includes a symmetric low-band portion and an asymmetric high-band portion. The low-band portion radiates in a low-band frequency range and includes a left low-band arm and a right low-band arm. The left low-band arm and the right low-band arm being substantially the same as the right low-band arm such that the low-band portion is substantially symmetrical about a central axis of the antenna trace. The high-band portion radiates in a high-band frequency range and includes a left high-band arm having a left length and a right high-band arm having a right length, the left high-band arm and the right high-band arm being asymmetrical about the central axis of the antenna trace such that the length of the right high-band arm is not substantially equal to the length of the left high-band arm.

In another embodiment, the present invention is a dual-dipole, multi-band conformal antenna that includes a balun, a pair of signal feed portions, a pair of symmetric low-band arms and a pair of asymmetric high-band arms. The low-band arms each include a single trace segment extending from a central portion of the antenna towards the respective ends, and located above their respective high-band arms. A first high-band arm includes multiple horizontal and vertical segments forming multiple bends and loops.

In yet another embodiment, the present invention includes a method of optimizing performance of an asymmetrical conformal antenna in a utility meter having a meter housing and distributed electrical components. The method includes vertically positioning an antenna including a low-band portion with left and right low-band arms and a high-band portion having left and right high-band arms inside a utility meter having a meter housing and distributed electrical components forming a high component density area and a low component density area. At least a portion of the low-band portion is located above a plane formed by a top surface of a meter housing and the distributed electrical components, and a portion of the high-band portion is located below the plane and adjacent the distributed electrical components.

The method also includes radially positioning the antenna about the meter housing and electrical components such that the left high-band arm is adjacent the low electrical component density and the right high-band arm is adjacent the high electrical component density, and then causing the antenna to radiate the energy at either a low-band frequency or a high-band frequency.

The above summary of the various embodiments of the invention is not intended to describe each illustrated embodiment or every implementation of the invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
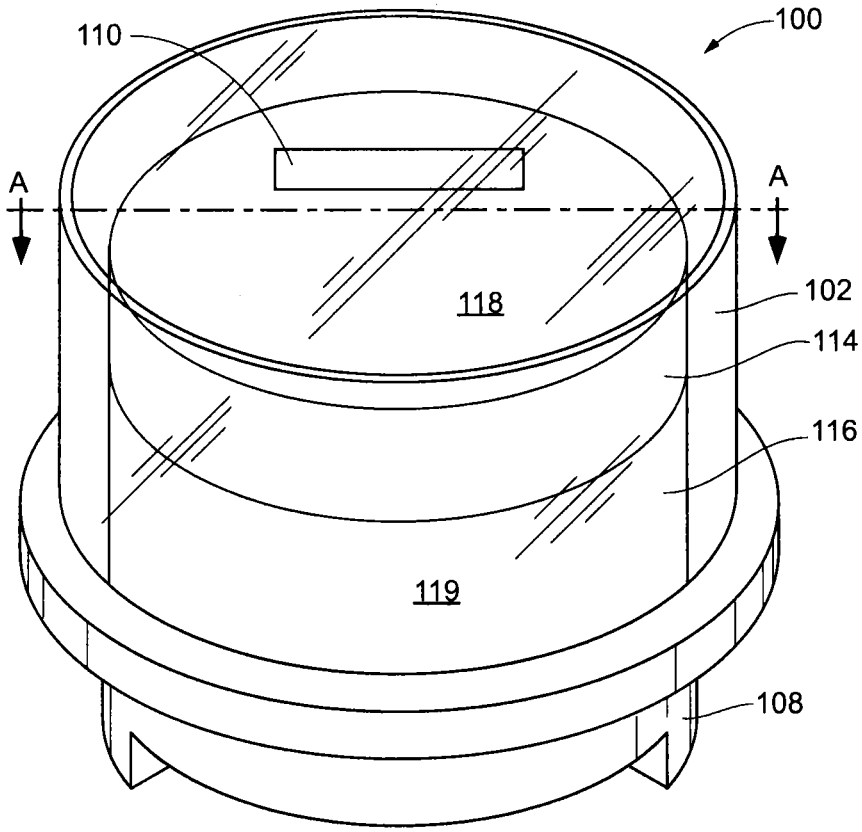
FIG. 1 is a front perspective view of an embodiment of a utility meter.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

The present invention includes several antennas conformal to utility meters and designed to provide optimal performance in both low and high bands. Such performance and efficiency includes the ability to pass relevant PCS Type Certification Review Board (PTCRB) and Carrier certifications. The novel antenna trace patterns in both low and high band arms of the antennas of the present invention, combined with the antenna placement within a utility meter further optimizes performance and efficiency. In some embodiments, such characteristics make it possible to pass Federal Communications Commission (FCC) peak gain requirements by achieving peak gains that are within the limits set forth by the FCC. Additionally, mechanical constraints and features related to the installation of the antennas leverage the unique characteristics of the antennas.

Although the antennas of the present invention are depicted in use with a meter for electricity, it will be understood that the antennas may be used with a variety of utility meters, including gas and water meters.

Figure 2:
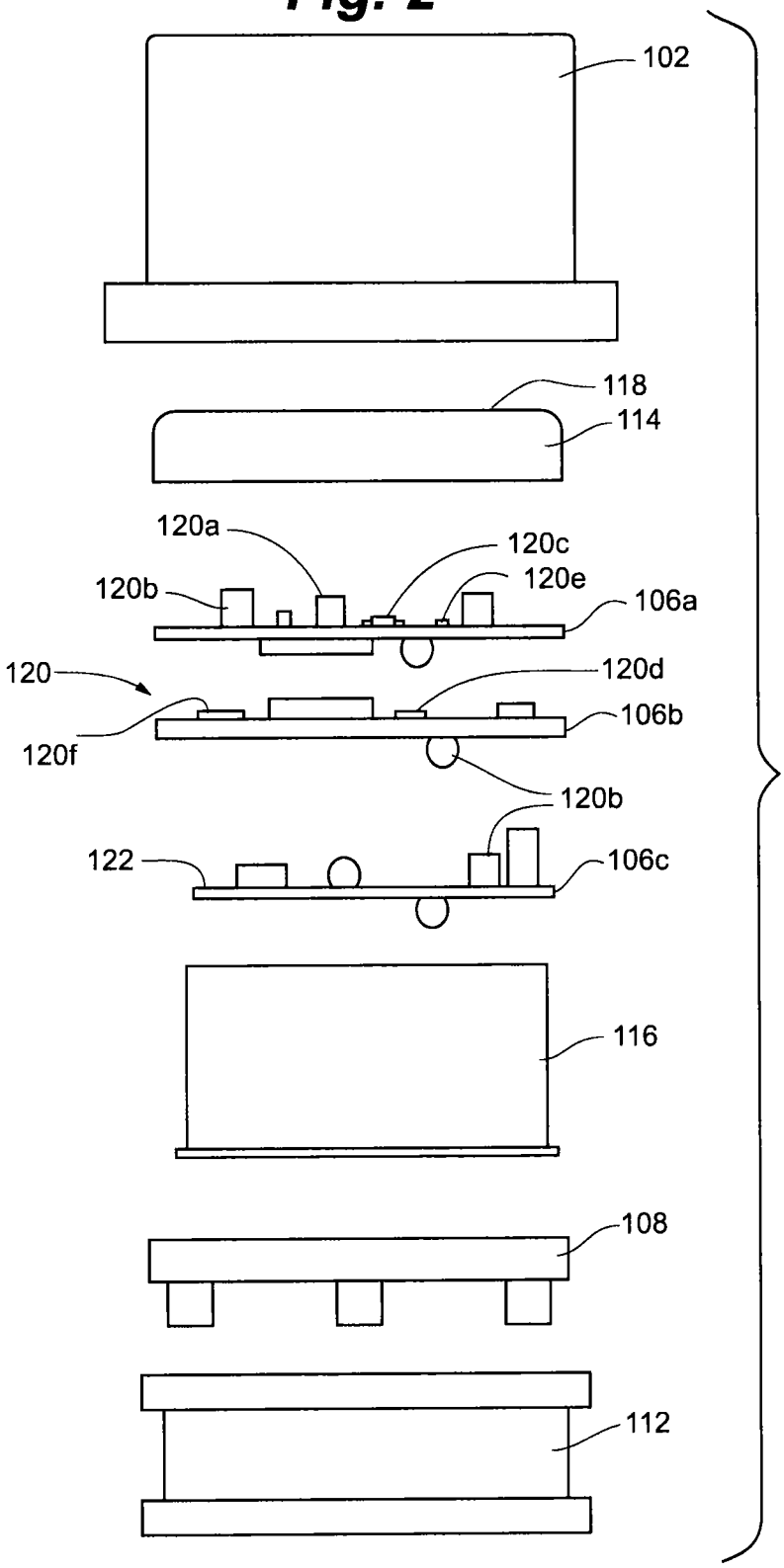
FIG. 2 is an exploded view of the utility meter of FIG. 1

Referring to FIGS. 1 and 2, a typical utility meter 100 is depicted. In the embodiment depicted, utility meter 100 is an electric utility meter, though it will be understood that the antennas of the present invention may be used with a variety of utility meters, and not just electrical meters for measuring electricity usage. In one embodiment, meter 100 includes cover 102, also referred to as a radome, or radome 102, meter housing 104, multiple printed circuit boards (PCBs) 106*a, b,* and *c*, adapter 108, display 110, and collar 112. As will be discussed further below, meter 100 may also include an antenna for wireless communication with a utility.

Cover 102 is typically comprised of a rigid, transparent material that provides protection to meter 100 and also allows display 108 to be viewed. However, in other embodiments, cover 102 may be an opaque material, such as in the case of a meter having no display, or an external display.

Meter housing 104 houses PCBs 106*a, b,* and *c*, and may be comprised as single, integral housing, or may be comprised of multiple pieces, such as the embodiment depicted that includes top cap 114, base 116, and top surface 118. Adapter 108 may be integrated into meter housing 104, or may be a separate part as depicted, and used to connect to collar 112 or to other metering structure at a location of meter 100. Meter housing 104 in one embodiment is generally cylindrical, with a generally flat, circular surface 118, as depicted. However, it will be understood that meter housing 104 may comprise other configurations.

PCBs 106*a, b, c* in the embodiment depicted may be generally circular to match meter housing 104, and include a plurality of electrical components 120 and conductive traces 122 and other electrical wiring, connectors, and so on. Electrical components 120 may include current transformers 102*a*, capacitors 120*b*, inductors 120*c*, resistors 120*d*, varistors 120*e*, various integrated circuit (IC) chips 120*f*, and other such electrical devices and components. Electrical components 120 may generally be located on a top surface of each of PCBs 106, but also may be attached to, and located on a bottom surface of PCBs 106.

Conductive traces 122 electrically connect electrical components 120 throughout each PCB 106, and are generally located on a top surface of each PCB 106. Electrical wiring and other connectors may be used to interconnect PCBs 106, or connect all or portions of meter 106 to external devices and components.

Figure 3:
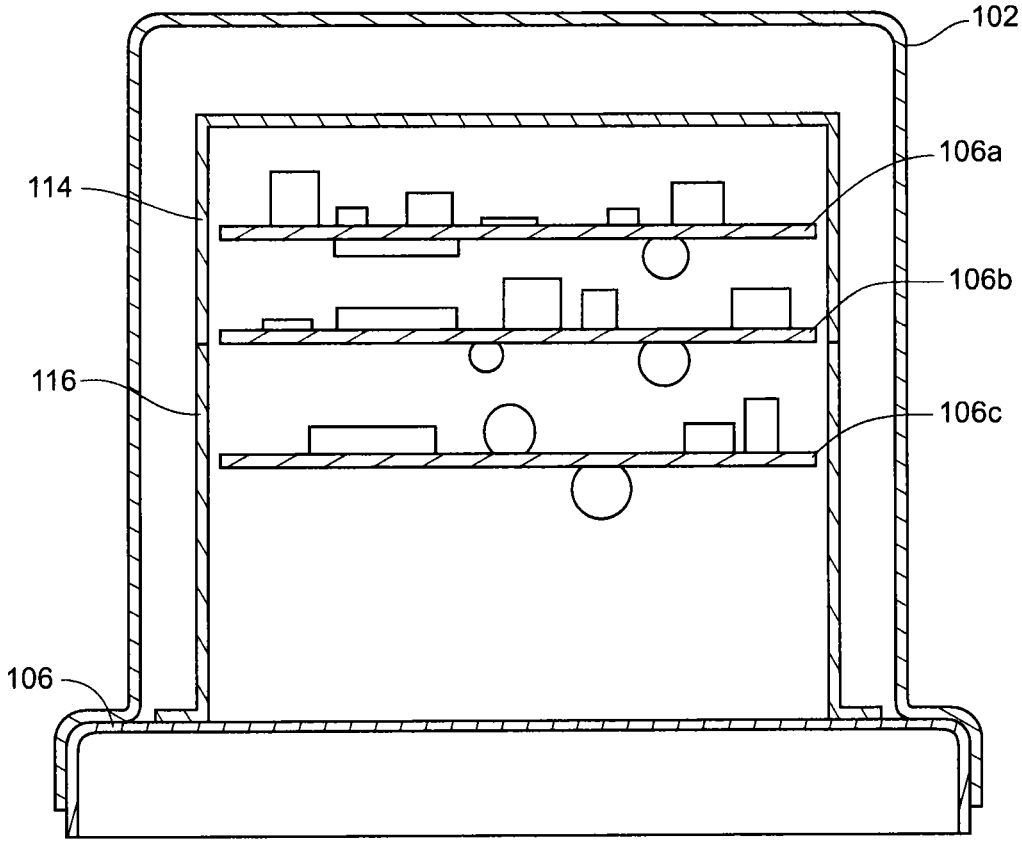
FIG. 3 is a cross-sectional view of the utility meter of FIG. 1.

Referring to FIG. 3, in one embodiment, meter 100 includes three PCBs 106*a, b,* and *c*, as described above, arranged in a stack, one atop the other, within meter housing 104. Although in the embodiment depicted, meter 100 includes three PCBs 106, in other embodiments, meter 100 may contain fewer or more PCBs 106, such as two or four PCBs. It will be understood that the actual spacing between PCBs 106 may vary, as will the distance from an inside top surface of cover 102 to PCBa, depending on meter design, and the spacing depicted is for illustrative purposes.

Figure 4:
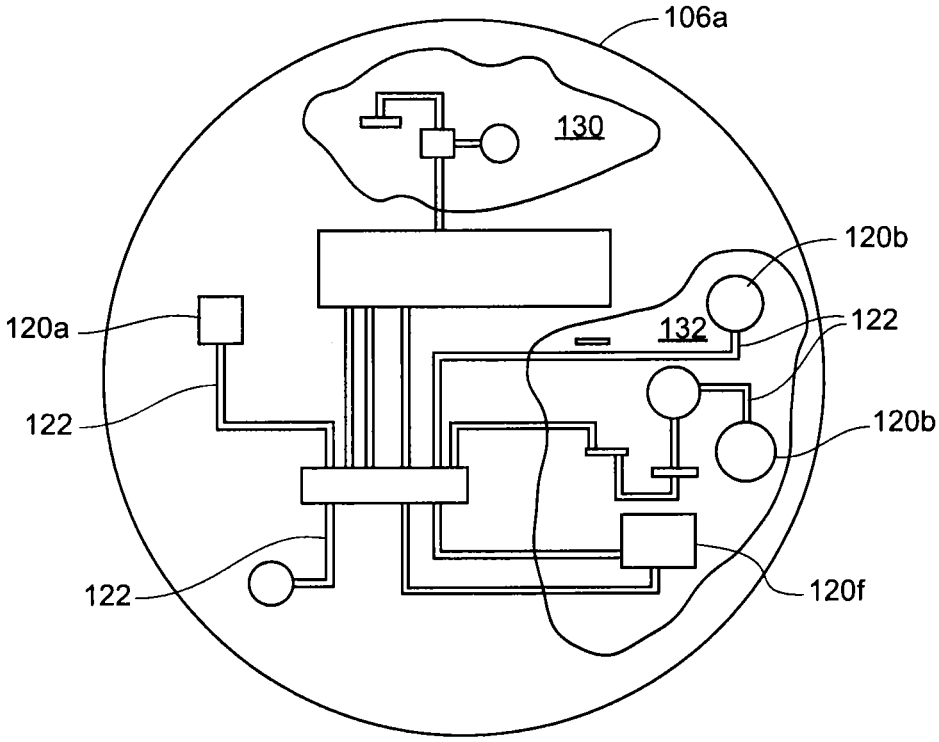
FIG. 4 is a top plan view of an embodiment of a printed circuit board of the meter of FIG. 1.

Referring to FIG. 4, the distribution of electrical components 120, traces 122 and electrical wiring will generally vary from meter to meter, and board to board, such that some areas of PCB 106*a, b,* or *c* will have differing concentrations of components, traces, and wiring. In the embodiment depicted, area 130 of PCB 106*a* includes relatively few electrical components 120 and traces 122, while area 132 includes relatively many electrical components 120 and traces 122. As will be discussed further below with respect to antennas of meter 100, the density of electrical components, traces, housing, conductive materials and other structure within particular areas of PCBs 106 and inside meter 100 affects antenna operation.

Figure 5:
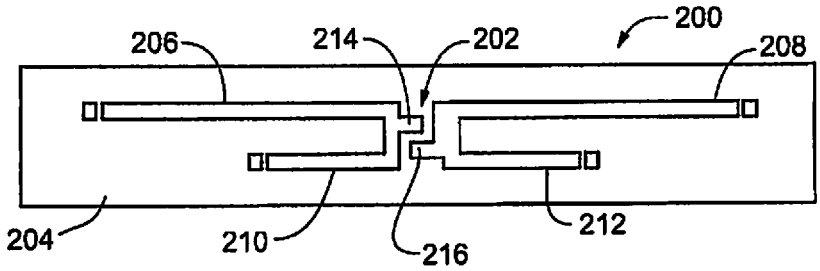
FIG. 5 is a front view of a prior art antenna.
Figure 6:
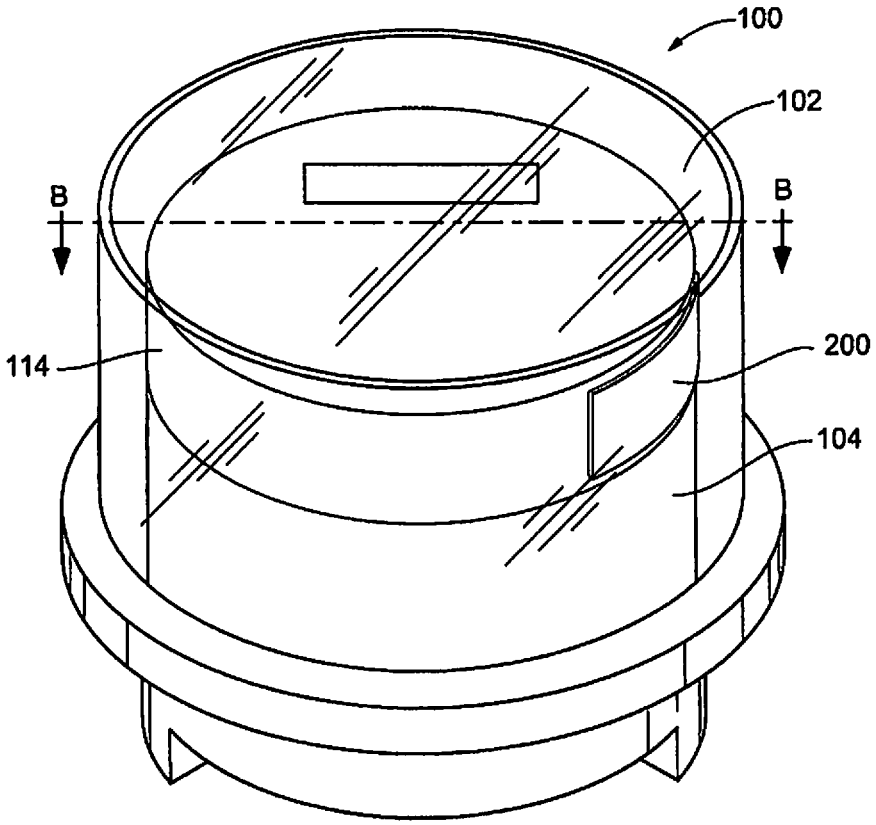
FIG. 6 is a front perspective view of an embodiment of a meter with the prior art antenna of FIG. 5 mounted to a meter housing.

Referring to FIGS. 5 and 6, meter 100 may include wireless communication capability so as to wirelessly transmit and receive data to and from a remotely-located utility. Such wirelessly-communicating meters 100 will include an antenna coupled to one or more of PCBs 106, and typically operating in the radio frequency (RF) spectrum. Such antennas may take a variety of forms and be located within or without meter 100.

In one embodiment, such an antenna may be located within housing 104 or within collar 112. However, portions of meter 100, or structures that meter 100 is mounted to, for example, conductive panels or boxes, may cause interference with the transmission and receipt of data. Such interference becomes more evident as the antenna is placed closer to items that reflect or otherwise interfere with data transmission.

One way to reduce interference is to locate the antenna at a point furthest from the panel or box or other structure supporting meter 100. In the embodiment depicted in FIG. 6, a known flexible, or "conformal" antenna 200, depicted in FIG. 5, is attached to an outside surface 119 of meter housing 104.

As depicted in FIG. 5, a known dual-dipole antenna 200 is sized to wrap around top cap 114 of housing 104, inside cover 102. Antenna 200 comprises an antenna trace 202 on backing 204. Antenna trace 202 is comprised of a pair of contiguous electrically conductive left and right portions, each comprised of electrically conductive materially, such as copper, or another metal or otherwise conductive material. With the exception of the trace elements for the signal feed wire, antenna 200 is substantially symmetrical about horizontal and vertical axes. Antenna trace 202 of antenna 200 includes low-band arms 206 and 208 which are the same size, and which extend away from the center of antenna 200 in a horizontal direction. Antenna trace 202 also includes a pair of high-band arms 210 and 212 located below low-band arms 206 and 208, respectively. High-band arms 210 and 212 are substantially the same size and do not include loops or bends, other than a single bend to connect to signal feeds 214 and 216.

Figure 7:
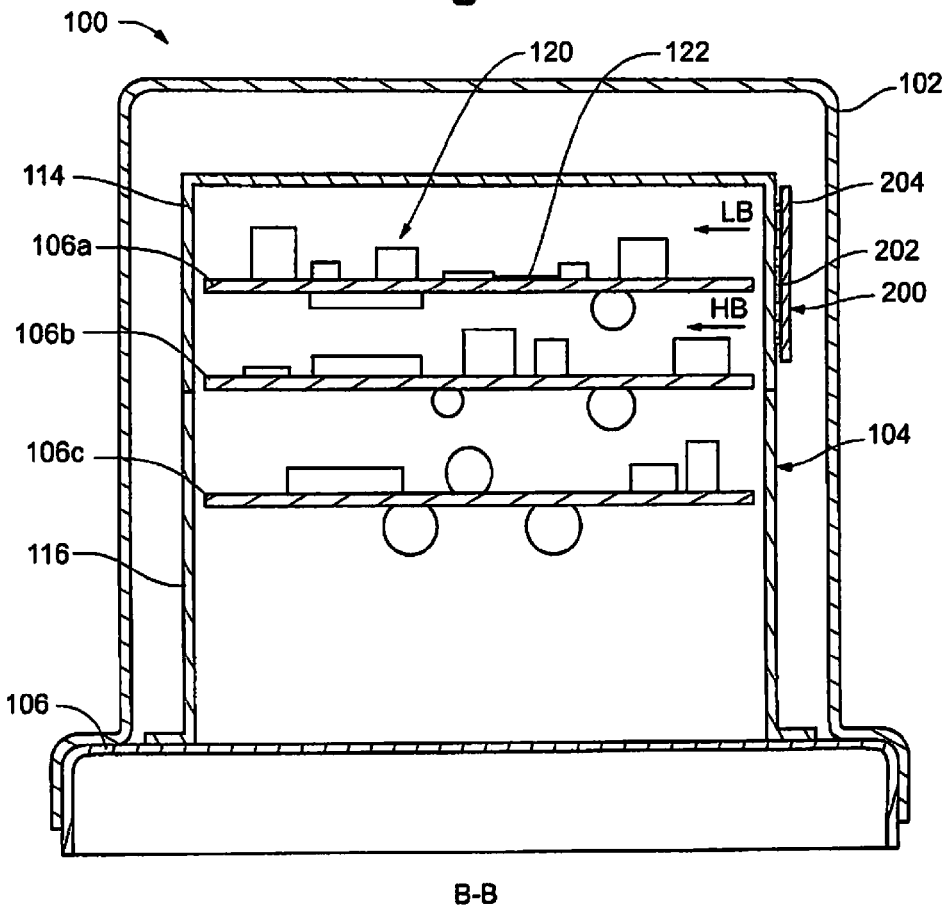
FIG. 7 is a cross-sectional view of the meter and antenna of FIG. 6.

Referring also to FIG. 7, a cross-section of meter 100 with antenna 200 wrapped on an upper portion of outside surface 119 of top cap 114 is depicted. Antenna 200 is affixed to the outside of top cap 114 on surface 119 such that trace 202 is adjacent to surface 119. Low band arms 206 and 208 are above high-band arms 210 and 212 in this position. Antenna 200 is generally adjacent PCBs 106*a* and 106*b*, and their electrical components 120 and traces 122.

In operation, antenna 200 radiates omni-directionally, with some of the electromagnetic radiation directed towards PCBs 106. Arrow LB illustrates that when radiating at a low-band frequency, a portion of low-band emitted energy as radiated from low-band arms 206 and 208 is directed towards PCB 106*a* and its electrical components 120 and traces 122. Similarly, Arrow HB illustrates that when radiating at a high-band frequency, a portion of high-band emitted energy as radiated from high-band arms 210 and 212 are directed toward PCB 106*b*, and possibly PCB 106*a*.

Although only a portion of the energy emitted from antenna 200 is directed into meter 100 and its PCBs 106, the overall efficiency and gain of antenna 200 will be affected in a generally adverse manner. The resulting performance degradation depends on many factors, including the rotational position of antenna 200 on meter housing 104 and top cap 114, density of PCB electrical components 120 in the vicinity of antenna 200, and of course, the overall characteristics of antenna 200, including trace 202 shape and size.

Referring to FIGS. 8 to 12, positioning systems, methods, and an antenna of the present invention for improved operation with meter 100 are depicted. Such systems, methods and antennas take into consideration the relative position of PCBs 106 in housing 104, the asymmetric component density of PCBs 106 to provide improved performance as compared to known antennas and antenna systems.

This improved performance is accomplished in a number of ways: positioning antenna 300 such that its low-band arms project into free space as much as possible; designing asymmetric high-band arms to match electrical component density of PCBs 106; creating a coupling of low-band and high-band arms while operating in high-band frequencies; and adjusting high-band arm geometry and size to account for known PCB characteristics. It will be understood that the term "electrical component density" refers to the density not only of components on PCBs 106*a, b*, and *c*, but may also include electrical traces on PCBs 106*a, b*, and *c*, as well as other conductive materials and other structure within particular areas of PCBs 106 and inside meter 100 which may affect antenna operation through coupling, reflection or loading effects.

Figure 8:
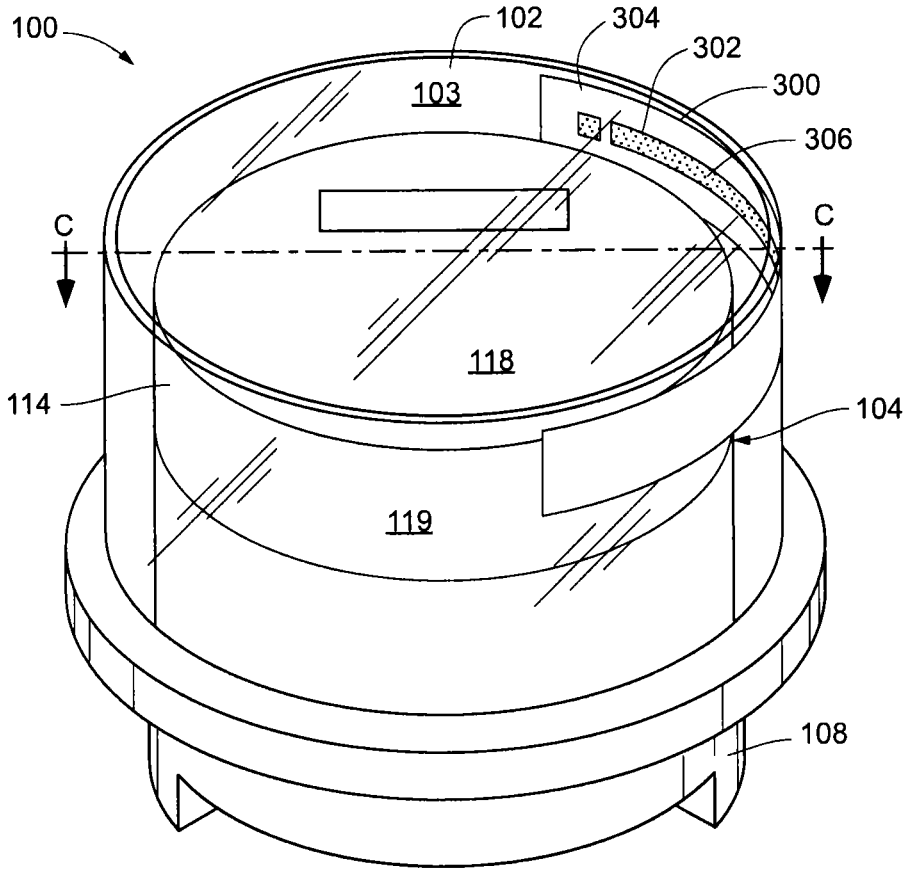
FIG. 8 is a top perspective view of an embodiment of a meter having an embodiment of an antenna of the present invention mounted in a meter cover.

Referring to FIG. 8, a wireless meter system that includes meter 100 with antenna 300 is depicted. As will be described further below antenna 300 comprises a multi-band, dual-dipole antenna operating at low-frequency and high-frequency ranges, and includes backing 304 with antenna trace 302.

Backing 304 may be a rigid material such as a printed circuit board, or may be a flexible material. In some embodiments, backing 304 is generally flat, and in other embodiments has a preformed curvature so as to follow the radius of cover 102 or top cap 114 of meter 100.

Figure 9A:
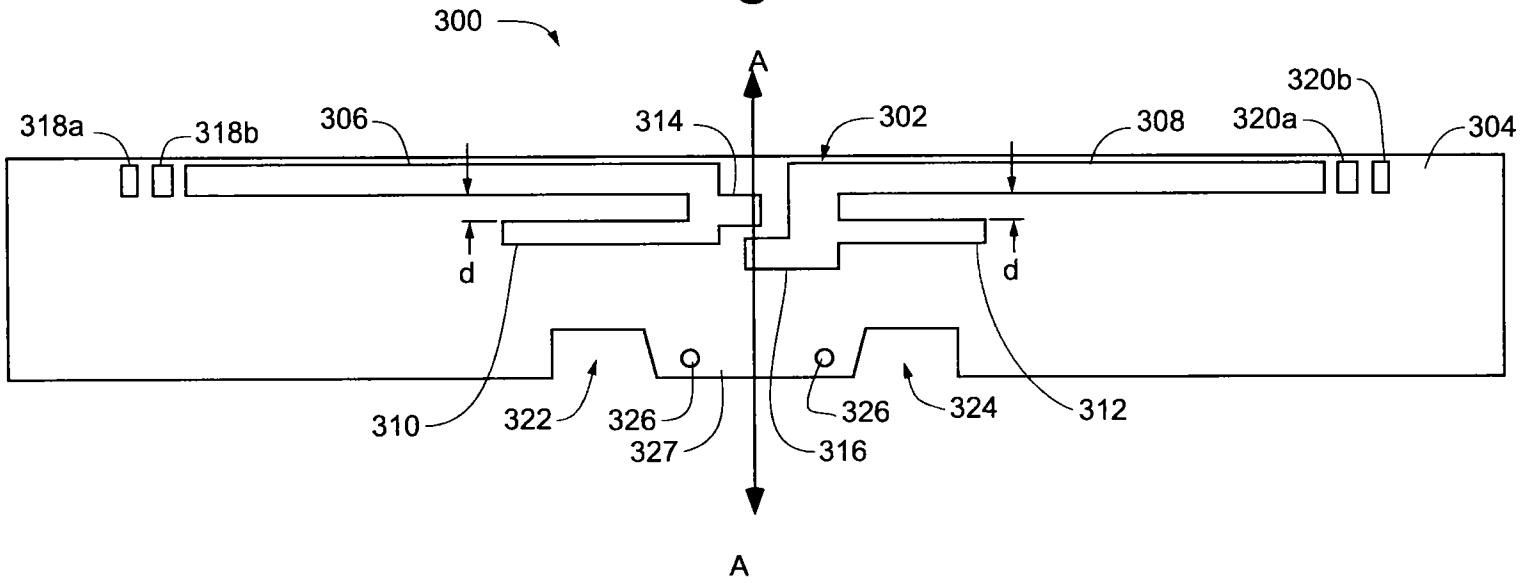
FIG. 9*a* is a front view of embodiment of an antenna of the present invention.
Figure 9B:
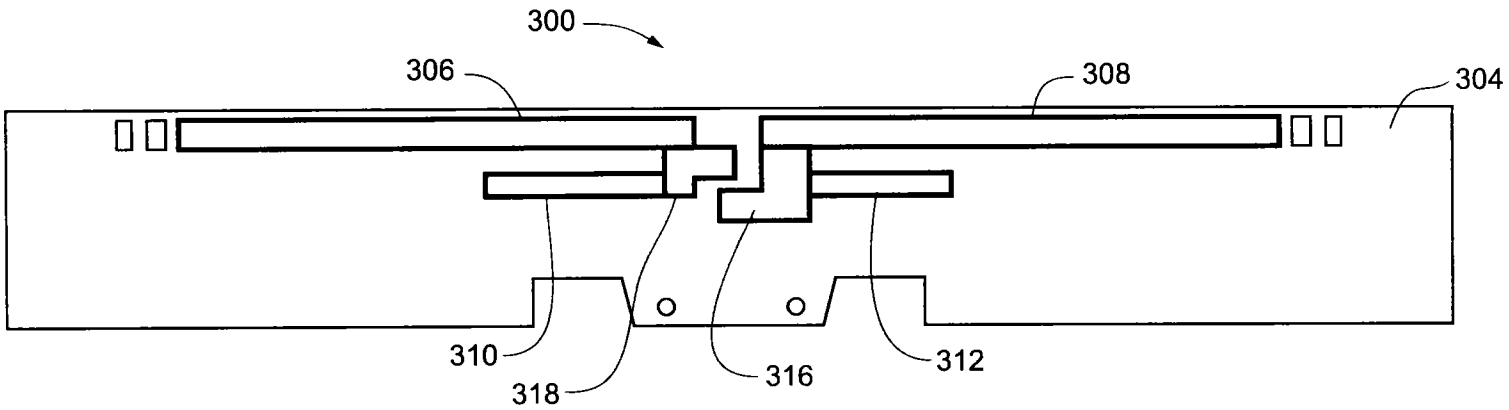
FIG. 9*b* is a front view of the antenna of FIG. 9*a*, depicting antenna trace segments.
Figure 9C:
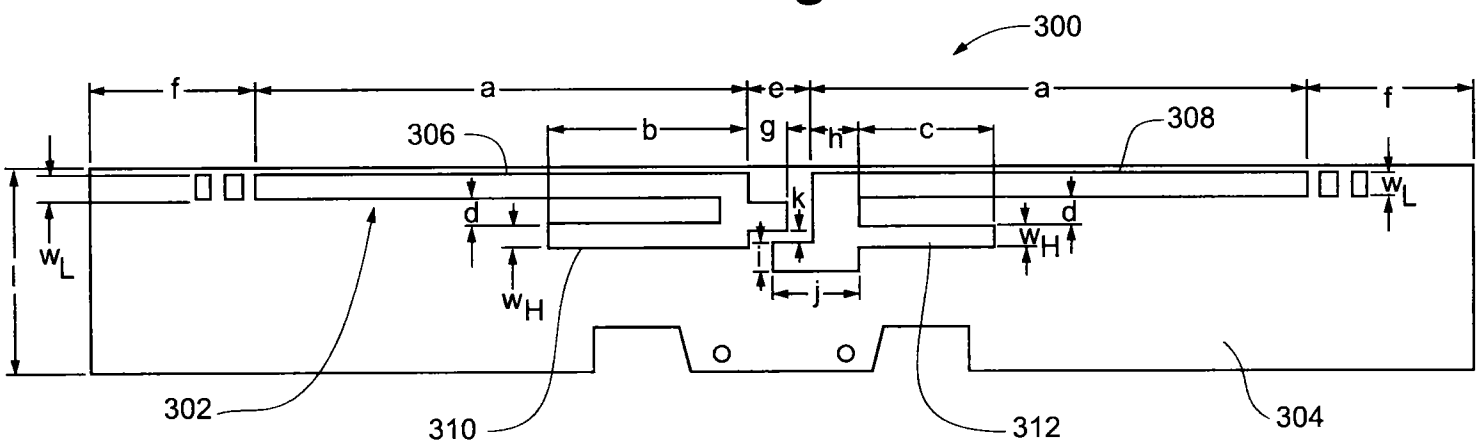
FIG. 9*c* is a front view of an embodiment of the antenna of FIGS. 9*a* and 9*b;*

Referring to FIGS. 9*a* to 9*c*, an embodiment of antenna 300 is depicted. Antenna 300 comprises a multi-band, dual-dipole antenna designed to operate in the low band from 902 to 928 MHz and in the high band at 2.4 to 2.5 GHz.

Referring specifically to FIG. 9*a*, antenna trace 302 of antenna 300 includes left low-band arm 306, right low-band arm 308, left high-band arm 310, right high-band arm 312, left signal-feed segment 314, right signal-feed segment 316, left extender segments 318*a* and 318*b*, and right extender segments 320*a* and 320*b*. Left low-band arm 306 and right low-band arm 308 comprise a low-band portion of antenna 300, while left high-band arm 310 and right high-band arm 312 comprise a high-band portion of antenna 300. Left low-band arm 306, left high-band arm 310 and left signal-feed segment 314 comprise a left portion of antenna trace 302, while right low-band arm 308, right high-band arm 312 and right signal-feed segment 316 comprise a right portion of antenna trace 302.

Referring specifically to FIG. 9*b*, the high and low band arms, and feed segments are outlined for clarity. Those skilled in the art will understand that feed segments 314 and 316 not only provide a connection in the form of a conduction path between a wire or cable carrying a received or transmitted signal, but also contribute somewhat to the radiation of high and low-band signals such that an exact separation point between feed segments and the high and low band arms in some cases may not possible to define in precise terms.

In some embodiments, right feed segment 316 may be larger in area than feed segment 314 so as to compensate for a shorter trace length of right high-band arm 312. This allows the conductive area of right-side portion of antenna trace 302 to be substantially equal to left-side portion of antenna trace 302. In other embodiments, conductive material may be added to other portions of antenna trace 302 so as to generally balance the conductive areas of the left and right portions.

Referring again to FIG. 9*a*, in one embodiment, backer 304 is generally rectangular to match the general shape of antenna trace 302. Backer 304 may also define left and right cutouts 322 and 324, as well as one or more holes 326. Backer 304 may also include tab 327. Cutouts 322 and 324 may receive portions of housing 104, holes 326 may receive projections extending outwardly from housing 104, and tab 327 may be received by structure of housing 104 such that antenna 300 is positioned in an appropriate location upon housing 104 of meter 100. Additional components as discussed further below may be used to secure antenna 300 to housing 104.

In an embodiment as depicted in FIG. 9*a*, antenna trace 302 is located nearly all the way towards a top margin of backing 304. As will be described further below, locating trace 302 towards a top portion of backing 304 will allow low-band arms 306 and 308 to be positioned in a plane above housing 104, PCB 106*a*, and electrical components 120, allowing the arms to "look" into free space and transmit and receive with minimal interference.

In the depicted embodiment, low-band arms 306 and 308 have substantially the same trace length and area, and are generally symmetrical about a central, vertical axis A. On the other hand, and for reasons described further below, high-band arms 310 and 312 may not have an equal trace length, and are not symmetrical about central, vertical axis A. It will be understood that the term trace length refers to the sum of the lengths of the various segments comprising any of the trace arms.

Left high-band arm 310 comprises a single trace element and extends parallel to, and below, low-band 306. Left high-band arm 310 generally does not include loops or bends. The trace length of left high-band arm 310 is the length of the single segment comprising left high-band arm 310.

Right high-band arm 312 also comprises a single horizontal segment. Segment 312 extends horizontally parallel to, and below, right low-band arm 308, but along an axis lying above signal feed portion 518. Right high-band arm 312 also generally does not include loops or bends.

A distance d between the low-band arms 306, 308 and their respective high-band arms 310, 312 is relatively close, such that when in high-band operation, high-band arms 310 and 312 couple in part with low-band arms 306 and 308, such that low-band arms 310 and 312 begin to act as high-band arms, improving overall gain and efficiency of the antenna. In one embodiment, d is approximately equal to the width of either the low-band arm 306 or the high-band arm 310. In another embodiment, d ranges from the width of high-band arm 310 to the width of low-band arm 306. In yet another embodiment, a width $W_L$ of low-band arms 306, 308 is 3.50 mm, a width $W_H$ of high-band arms 310, 312 is 2.74 mm, and distance d is 3.00 mm. In general, the larger the distance d between high- and low-band arms, the weaker the coupling effect. On the contrary, in known conformal antennas for utility meters, distance d is designed to be large enough to effectively eliminate such a coupling effect between the arms.

Referring also to FIG. 9*c*, in general, the dimensional relationships between the various segments of antenna trace 302 ensure optimal performance when mounted optimally in meter 100. An embodiment of antenna trace 302 with dimensional references is depicted, with tolerances ranging from +/−0.5 to +/−1 mm. In the depicted embodiment, low-band arms 306 and 308 length a is substantially 60.45 mm, left high-band arm 310 trace length b is substantially 24.90 mm, right high-band arm 312 trace length c is substantially 16.50 mm, low-band arms 306, 308 width $W_L$ is substantially 3.50 mm, high-band arms 310, 312 width $W_H$ is substantially 2.75 mm, separation distance d is substantially 3.00 mm. Other dimensions in this particular, non-limiting embodiment are as follows: e is substantially 7.50 mm, f is substantially 20.80 mm, g is substantially 5.04 mm, h is substantially 6.00 mm, i is substantially 2.75 mm, j is substantially 11.03 mm, and k is substantially 1.43 mm. Backing 304 in an embodiment is substantially 170 mm long and 25 mm high (dimension 1).

However, it will be understood that in other embodiments, the dimensions of both trace 302 and backing 304 may be changed, including embodiments where the overall pattern and shape of antenna trace 302, as well as dimensional relationships amongst its segments, remain. In yet other embodiments, certain dimensions may be adjusted slightly to accommodate PCBs with varying current densities, as discussed further below.

Figure 10:
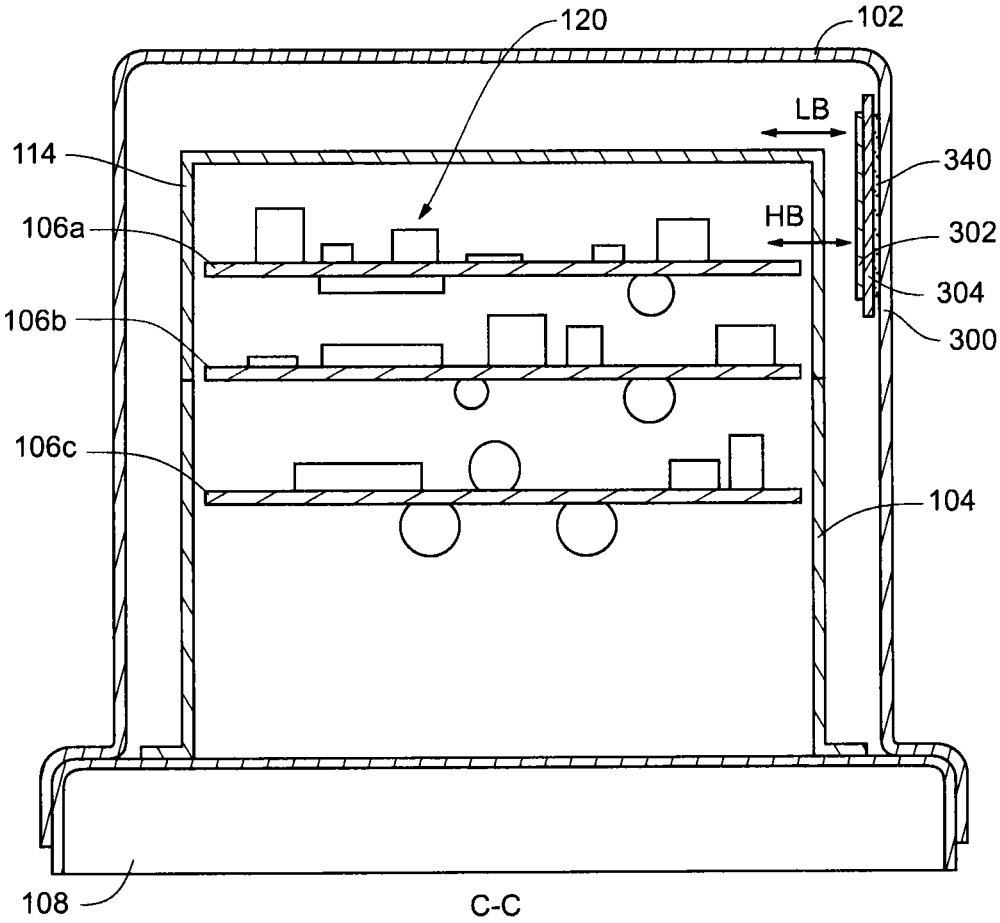
FIG. 10 is a cross-sectional view of the meter and antenna of FIG. 8.

Referring again to FIG. 8, and also to FIG. 10, meter 100 includes antenna 300 positioned at a height and radial position that yields optimal performance. Antenna 300 is flexed, or curved to follow the curvature of housing 104 and/or an inside surface 103 of cover 102, and in this embodiment is affixed to an inside surface 103 at nearly the uppermost portion of cover 102. Antenna 300 may be affixed to surface 103 in a variety of ways, including through the use of double-backed tape 340, adhesive, or other mechanical means.

Unlike previously known positioning systems, in this system, antenna 300 is positioned at a height such that low-band arms 306 and 308 lie substantially above a plane formed above top surface 118 of meter housing 104 and its top cap 114. As such, neither top cap 114, nor PCBs 106 are adjacent low-band arms 306 and 308, allowing them to "look" into free space. This minimizes interference with, and reflection of, RF signals received and transmitted via low-band arms 306 and 308 during low frequency transmission.

Referring specifically to FIG. 10, and recognizing the actual omnidirectional nature of antenna 300, Arrows LB and HB represents transmission and reception of a low-band signal and a high-band signal, respectively, of antenna 300. Arrow LB depicts a low-band signal free to travel through the free space above housing 104 without interference. Arrow HB depicts a high-band signal that still must contend with adjacent meter 100 structure, including housing 104 and PCBs 106.

In other embodiments, all, or portions, of high band arms 310 and 312 may lie above the plane formed by the top of housing 104.

Figure 11:
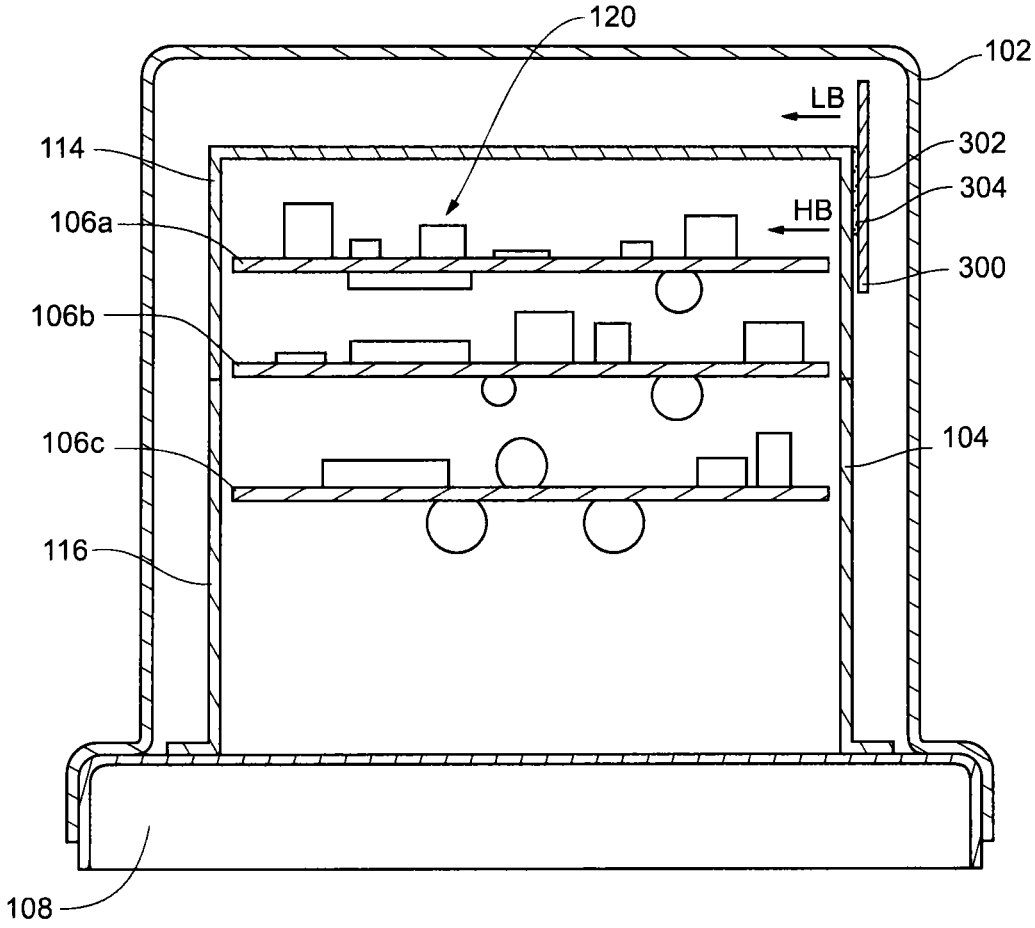
FIG. 11 is a cross-sectional view of the meter and antenna of FIG. 8, with the antenna alternatively mounted to the meter housing.

Referring to FIG. 11, in an alternate position, antenna is also positioned at an optimal height within meter 100 such that low-band arms 306 and 308 are positioned completely or partially above meter housing 104, but in this embodiment, antenna 300 is affixed to housing 104, rather than cover 102.

Positioning antenna 300 at an "over-the-housing" height such that low-band arms 306 and 308 are fully or partially above PCBs 106 and housing 104 significantly improves antenna performance, especially low-band performance as will be described further below.

Figure 12:
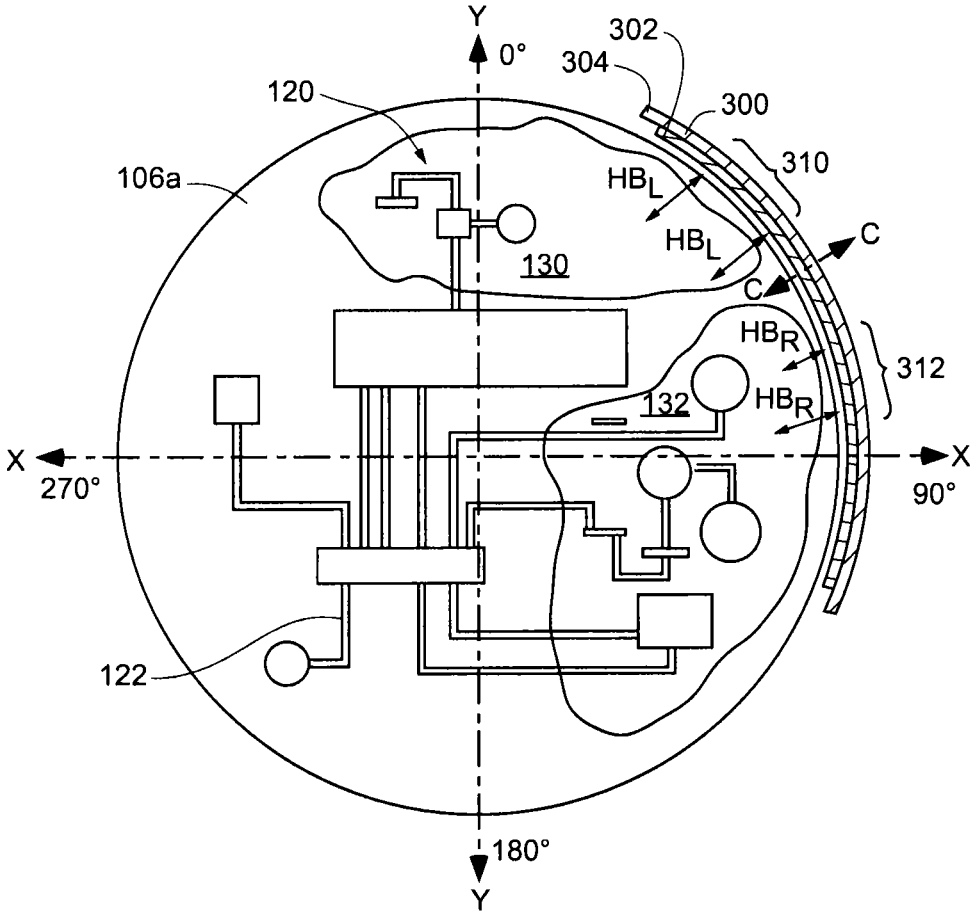
FIG. 12 is a top plan view of an embodiment of printed circuit board of the meter and antenna of FIG. 8.

Referring to FIG. 12 is a top plan view of antenna 300 positioned adjacent PCB 106*a*. As described briefly above, the radial position of antenna 300 on meter 100 also affects performance, especially high-band performance.

FIG. 12 depicts vertical reference axis Y and horizontal reference axis X, and radial position references about the circumference of PCB 106*a* in degrees, so as to describe the radial positioning of antenna 300 with respect to PCB 106*a*.

In the embodiment depicted, PCB 106*a* includes areas of low-component density, such as area 130, and high-component density, such as area 132. Although only a single low-component density area and a single high-component-density area are depicted, it will be understood that multiple such areas may exist throughout PCB 106*a*. Further, the component density characteristics of a PCB 106 may be more finely differentiated to define low, medium and high component densities, or a ranking with even more categories of component densities may be defined. Generally, it will be understood that a higher concentration of electrical components 120, conductive traces 122, and other wiring and/or connectors, in an area of a PCB 106 will cause greater signal reflection of, and interference to, portions of an antenna signal traveling through such an area.

In one embodiment, the characterization, or mapping of component densities may be determined by physical component 120, trace 122, and wiring density. In another embodiment, testing of the interference caused by transmitting or receiving through particular areas of PCB 106 may be used to define areas as relatively low or high component density areas. Also, as mentioned above, such component densities will vary from PCB to PCB within a single meter, and from meter to meter.

In the embodiment depicted in FIG. 12, antenna 300 is generally adjacent PCB 106*a*, and radially positioned between 0 degrees and 180 degrees, with respect to PCB 106*a* (and housing 104). Axis C indicates a center axis of antenna 300 such that a left portion of antenna 300 lies on one side of axis C, and a right portion of antenna 300 lies on the other side of axis C.

Left high-band arm 310 is positioned between approximately 30 and 60 degrees, in this embodiment, and generally adjacent low-component-density area 130. Right high-band arm 312 is positioned approximately between 70 and 100 degrees, and adjacent high-component density area 132.

In a typical, known utility-meter dual-dipole antenna, the left and right high-band arms would be of substantially equal size, and distributed symmetrically about center axis C. Such an antenna design would not take into account the asymmetry of adjacent PCB 106 and its electrical component density. For example, a right high-band arm radiating into a high-component density area will produce reflections and interference to a greater extent than a left high-band arm radiating into a low-component density area. The portion of the signal radiated from the right side of antenna will likely see higher reflection, and hence higher gain as compared to the left side of the known antenna, requiring overall adjustments in gain and efficiency in order to comply with various standards, including FCC requirements. The combination of asymmetry of PCB 106 components 120, i.e., electrical component density, and the symmetry of the known antenna thus results in compromised performance.

On the contrary, asymmetric antenna 300 of the present invention is optimized so as to accommodate the asymmetric characteristics of PCB 106 and meter 100. Referring still to FIG. 12, left high-band arm 310 is adjacent low-component-density area 130, and receives and transmits portions of a signal directed toward PCB 106*a* as indicated by the arrows $HB_L$. Right high-band arm 312 is adjacent high-component-density area 132, and receives and transmits portions of a signal directed toward PCB 106*a* as indicated by the arrows $HB_R$. Because of the higher component density, right high-band arm 312 will receive a greater degree of reflected signal as compared to left high-band arm 310.

Referring also to FIG. 9*a*, to adjust for this effect, and the variance in component densities, in this embodiment, right high-band arm 312 is generally shorter than left high-band arm 310. The difference in length will vary with the differences in component densities and resulting degrees of reflection and interference.

Therefore, antenna 300 is designed to have asymmetric high-band arms that take into consideration different areas of component densities in an adjacent PCB 106, then is place at an optimal radial position about PCB 106 such that the high-band arms are located adjacent the appropriate areas of PCB 106.

In some embodiments, to equalize current flow through each of left high-band arm 310 and right high-band arm 310, additional conductive trace material is added to antenna trace 302. Such additional material is shown as additional conductive trace material in the area defined as right feed signal segment 316, and as depicted in FIG. 9*b*.

Overall, the performance of antenna 300 is optimized by incorporating a number of antenna design features and positional factors. Antenna trace 302 may initially be sized and shaped to radiate in the appropriate bands assuming asymmetric environmental interference, but then the size of the high-band portions of trace 302 are adjusted to cause asymmetry in the antenna high-band arms 310 and 312. Further, low-band arms 306 and 310 are located at a top of backing 304 to allow low-band arms to be positioned at a height at least partially, if not completely, above housing 104, thereby optimizing low frequency operation. Additionally, antenna 300 is placed at an optimal radial position with respect to meter housing 104 and PCBs 106 such that high-band arms 310 and 312 are matched to the appropriate and optimal electrical component densities of PCBs 106.

Figure 13B:
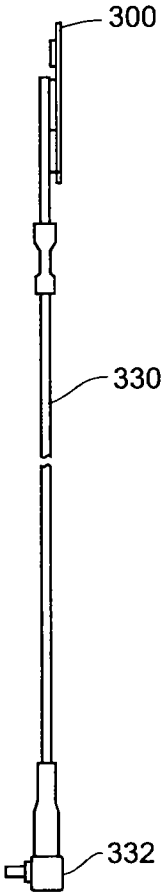
FIG. 13*b* is a right-side view of the antenna of FIG. 13*a;*
Figure 13A:
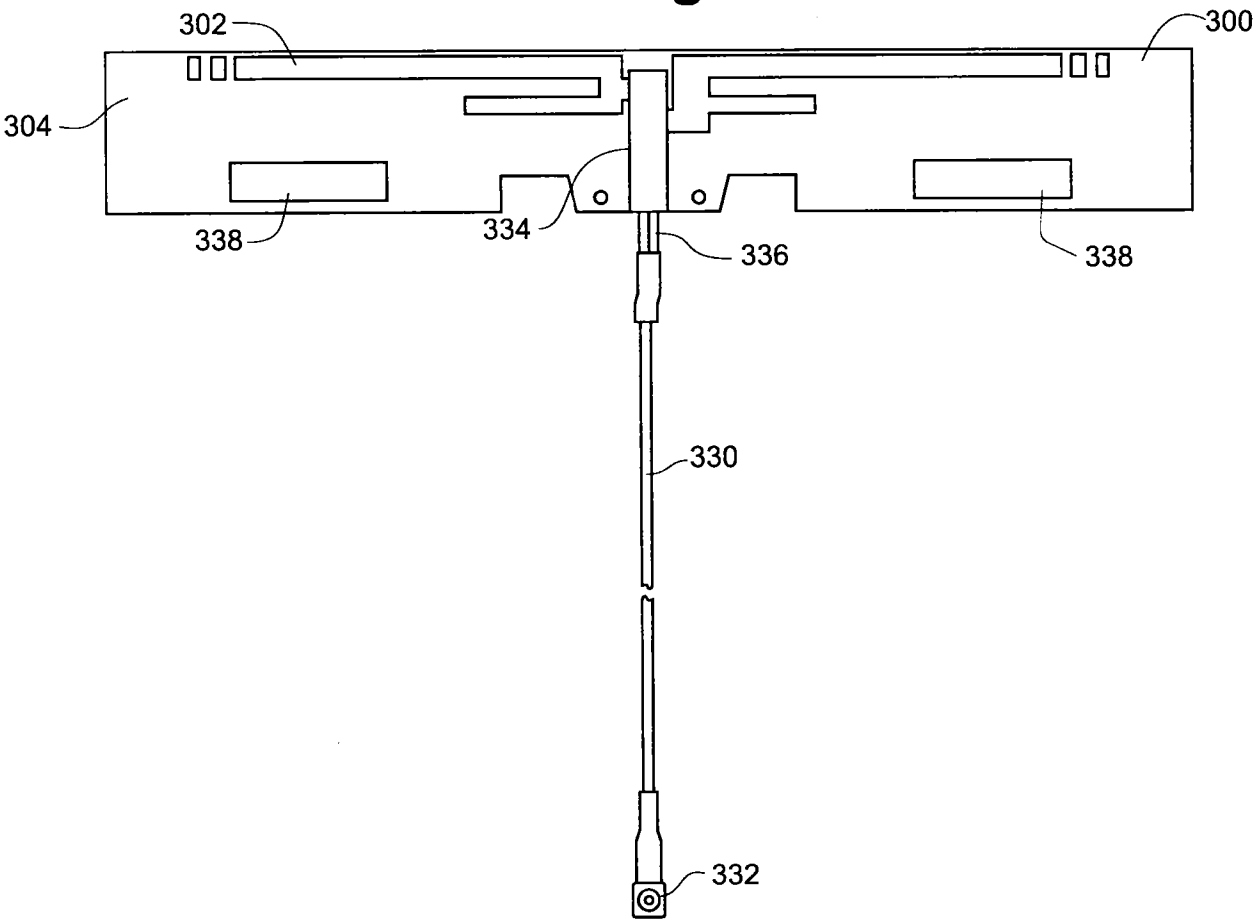
FIG. 13*a* is a front view of an embodiment of the antenna of FIG. 9, including a cable.

Referring to FIGS. 13*a* and *b*, antenna 300 is depicted to illustrate several features used to properly position the antenna on meter 100, as well as signal-carrying cable 330.

In one embodiment, antenna 300 also includes cable 330 with connector 332. In one embodiment, cable 330 comprises an RG178 cable and connector 332 comprises an RA MMCX plug. A distal end of cable 330 connects to antenna 300 at signal feeds 316 and 318, while a proximal end of cable 330 via connector 332 connects to meter 100. It will be understood that any of the antennas of the present invention may this cable, or a similar cable.

In some embodiments, cable 330 may be eliminated altogether. In such an embodiment, antenna 300 is adhered to or otherwise attached to an inner surface of cover 102 or housing 104, and is joined to housing 104 at fixed feed and ground leads. Such an embodiment may include pins on the antenna ground and feed pads that snap into mating sockets on housing 104, adapter base 108 or collar 112.

The portion of antenna 300 receiving the distal end of cable 330 may be covered with covering 334. In one embodiment, covering 334 comprises a high-density ultra-violet (UV) sensitive material that hardens under UV radiation to provide a protective covering.

In an embodiment, antenna 300 may also include a balun 336. Balun 336 helps with impedance matching without lengthening arm length. In one embodiment, balun 334 is a 30 mm balun attached at the distal end of cable 330.

In an embodiment, antenna 300 also includes one or more antenna positioning tabs 338. Tabs 338 may comprise 0.025 inch thick mylar with adhesive material, such as double-sided tape to adhere the mylar to antenna 300 and/or adhere ends of antenna 300 to housing 104, thereby holding antenna 300 in the appropriate, optimal position. Although depicted on the trace-side of antenna 300, positioning tabs 338 alternatively could be located on the opposite side of antenna 300 to adhere the antenna to inside surface 103 of cover 102. In some embodiments, positioning tabs 338 may be received by slots or recesses in housing 104 or cover 102 to position antenna 300 with or without adhesive.

Although a particular antenna design embodied by antenna 300 has been describe above, it will be understood that a variety of other antenna designs may incorporate the features described above, including optimal antenna placement, low-band arm freedom, asymmetric high-band arms, and so on. Several alternative embodiments that utilize these features are described below.

As described above, the present invention includes several methods for optimizing performance of an asymmetrical conformal antenna in a utility meter. In an embodiment, one such method includes the steps of positioning the antenna inside meter 104 at an optimum height with respect to meter housing 104. In this position, at least part of a low-band antenna trace is located above a plane formed by top surface 108 of a meter housing 105. In some embodiments, the entire low-band portion of the trace is above the top surface, while nearly all of a high-band portion is in a plane below top surface 108. The low-band trace may be just above the top surface, or significantly above the top surface, near the very top of a cover 102 of meter 100. Positional markings on the antenna may be used to correctly locate the antenna.

Such a method also includes optimizing a radial position of an antenna having asymmetrical high-band arms, such as antenna 300. Steps include determining loading or coupling characteristics which may be determined by electrical component density of PCBs 106 and other meter components including housing 104, power components, and so on. The antenna is positioned radially such that the high-band antenna trace is matched to the loading characteristics, including electrical component densities. This includes locating a high-band arm having a shorter length near areas with higher component densities and placing a high-band arm having a longer length near areas with lower component densities.

Methods also include mechanically attaching an antenna to meter 100. In some embodiments, backing, such as backing 304, is attached to housing 104 by inserting projections of meter housing 104 into holes of the antenna, and by inserting tabs and recesses in the antenna into corresponding recesses and tabs in housing 104. In other embodiments, the antenna is affixed to an inside surface of cover 102. The antenna may be affixed to cover 102 using mechanical means described above and similar to attaching to housing 104, or the antenna may be affixed to cover 102 using an adhesive.

Antennas of the present invention may include a cable to electrically connect the antenna to meter 100. In other embodiments, the antenna may include signal and/or ground pads that connect directly to receiving connectors in meter 100 such that the use of a cable is avoided.

Figure 14:
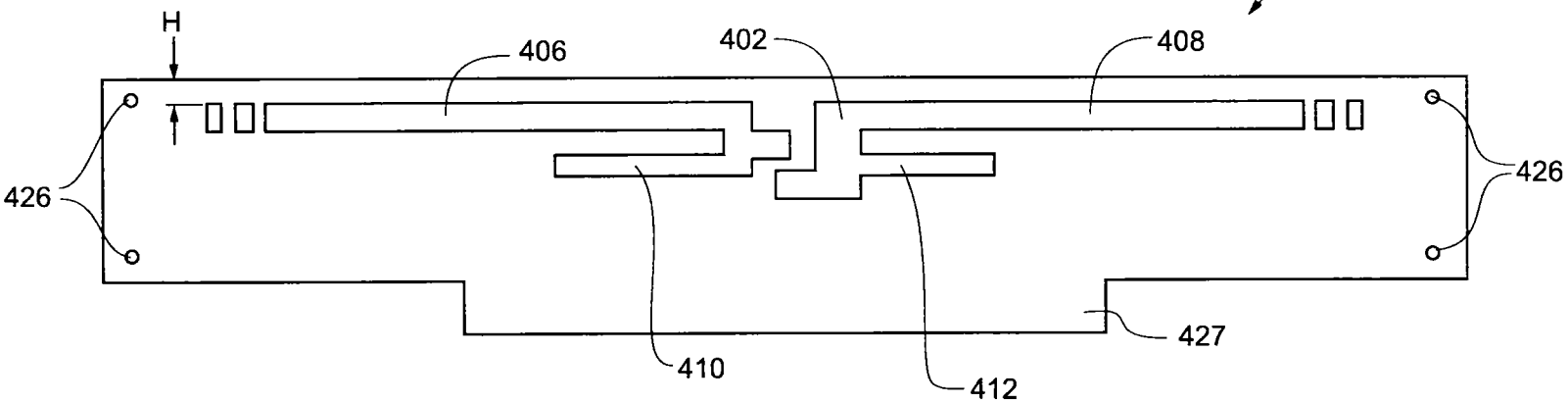
FIG. 14 is an embodiment of another antenna of the present invention.

Referring to FIG. 14, an alternate embodiment, antenna 400 is depicted. Trace 402 of antenna 400 is substantially the same as trace 302 of antenna 300, though in one embodiment the dimensions of the feed segments of antenna 402 are altered slightly in a symmetrical fashion.

However, the position of trace 402 on backing 404 varies from antenna 302, as does the backing 404 itself. More specifically, trace 402 is somewhat further from the top of backing 404. In one embodiment, a top portion of the low bands of trace 402 are a distance H from the top of backing 404, and H ranges from 2 to 3 mm. In this particular embodiment, H is determined based on the characteristics of meter 100 and is selected such that low band arms 406 and 408 are just above a top surface 108 of a housing 104 (not depicted). In this embodiment, trace 402 is still substantially at a top of backing 404, but is not as close as to the top as compared to trace 302 and its backing 304. The position on backing 404 depends in part on the physical characteristics of meter 100, cover 102, and housing 104, with the aim of locating low band arms 406 and 408 just above a plane formed by top surface 108.

Backing 404 also differs slightly from backing 304 in order to secure antenna 400 to housing 104. In this embodiment, backing 404 includes a tab 427 to be received by housing 104 and multiple holes 426 to fit over projections of housing 104, in order to optimally position antenna 400 in meter 100.

Figure 15:
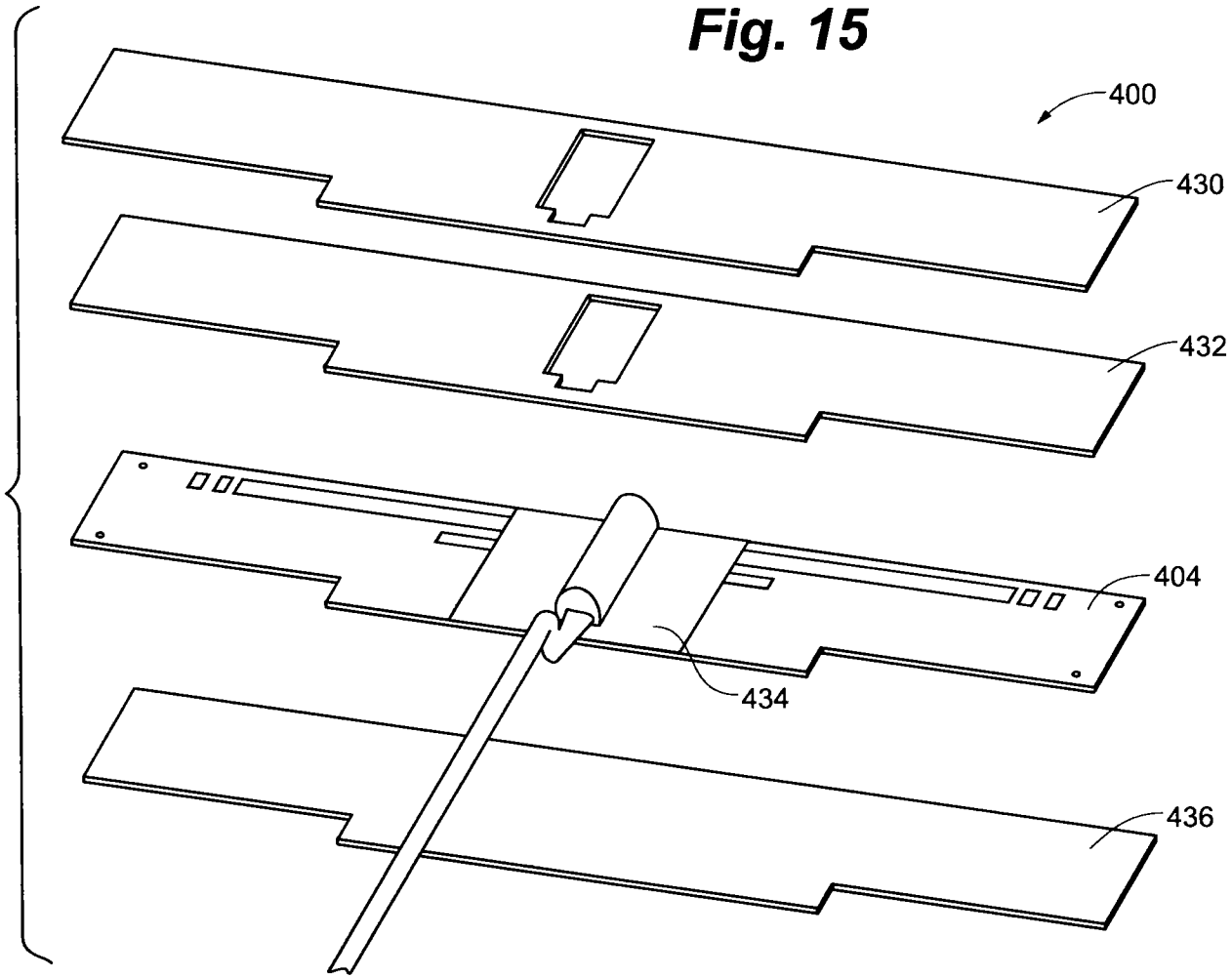
FIG. 15 is an embodiment of the antenna of FIG. 14 having a multi-layer construction and cable.

Referring to FIG. 15, an embodiment of antenna 400 comprises a multi-layer design for protecting and securing antenna 400. This multi-layer feature may be used for any of the antennas of the present invention with only a few dimensional changes to accommodate specific backing and antenna geometry. In the depicted embodiment, layer 430 comprises a protective layer comprised of a 10 mil polycarbonate material; layer 432 comprises an adhesive layer, that in one embodiment comprises a 2 mil thick double-stick tape; layer 434 in an embodiment comprises a single-sided tape, and layer 436 is a 2 mil thick double-stick tape to adhere antenna 400 to an inside surface of meter 100.

Figure 16:
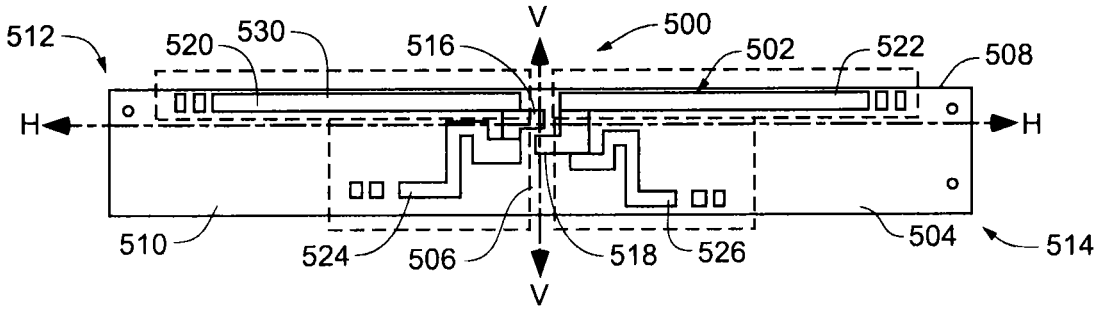
FIG. 16 is a front view of another embodiment of an antenna of the present invention.
Figure 17:
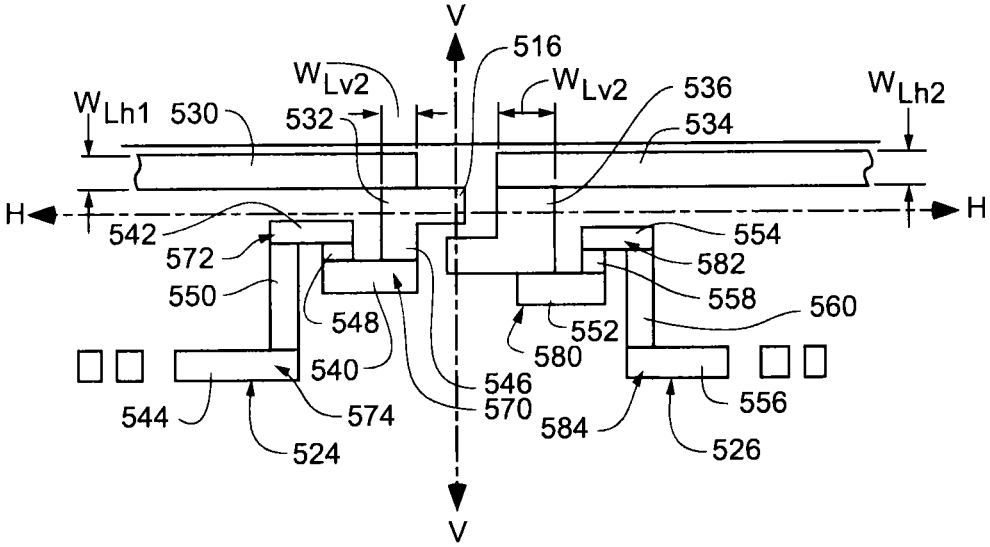
FIG. 17 is a partial front view of the antenna of FIG. 16.

Referring to FIGS. 16 and 17, an embodiment of the present invention, antenna 500, is depicted. Antenna 500 is a multi-band, dual-dipole antenna operating at low-frequency and high-frequency ranges. Antenna 500 includes antenna trace 502 and backing 504.

Antenna trace 502 may comprise a copper or other conducting material, and may take the form of a printed copper trace.

Antenna trace 502 includes signal feed portions 516 and 518, left low-band arm 520, right low-band arm 522, left high-band arm 524 and right high-band arm 526. Signal feed portions 516 and 518 are located at horizontally-central portion 506 of backing 504, while low-band arms 520 and 522 are generally located at top portion 508 of backing 504.

Left low-band arm 520 includes first horizontal segment 530 and first vertical segment 532; second low-band arm 522 includes second horizontal segment 534 and second vertical segment 536. First horizontal segment 530 extends from central portion 518 in a direction parallel to horizontal axis H, towards first end 512 of backing 504. Second horizontal segment 534 extends from central portion 518 towards second end 514. In one embodiment, first and second horizontal segments 530 and 534 each extend substantially half the length of backing 502. Vertical segments are significantly shorter than horizontal segments 530 and 534, and join horizontal segments 530 and 534 to signal feed portions 516 and 518, respectively. Vertical segment 536 may be longer than vertical segment 532 due to the placement of feed portions 516 and 518.

In the embodiment depicted, horizontal segments 530 and 534 have widths $W_{Lh1}$ and $W_{Lh2}$, respectively, which are substantially equal. Vertical segments 532 and 536 have widths $W_{Lv1}$ and $W_{Lv1}$, respectively. Widths $W_{Lv1}$ and $W_{Lv1}$ may be unequal as depicted.

Referring to specifically to FIG. 17, each high-band arm 524 and 526 includes multiple horizontal and vertical segments to form a series of bends and loops. More specifically, left high-band arm 524 includes first horizontal segments 540, 542, and 544, and first vertical segments 548 and 550. Right high-band arm 526 includes second horizontal segments 552, 554, and 556, and second vertical segments 558, 560, and 562.

Left high-band arm 524 also includes multiple U-shaped partial loops, or bends, 570, 572, and 574. Loop 570 is formed of segments 546, 540 and 548; loop 572 is formed of segments 548, 542, and 550; and bend 574 is formed of segments 550 and 544.

Right high-band arm 526 includes multiple U-shaped partial loops, or bends, 580, 582, and 584. Loop 580 is formed of segments 560, 558, and 562; loop 582 is formed of segments 562, 554, and 564; bend 584 is formed of segments 564 and 556.

In an embodiment, loop 570 of left high-band arm 524 is slightly larger than loop 580 of right high-band arm 526, with segment 540 having a length of 9.50 mm, while segment 558 has a shorter length of 8.75 mm. Loop 572 of left high-band arm 524 is also slightly larger than loop 582 of right high-band arm 526, with segment 542 having a length of 8.00 mm, while segment 554 has a shorter length of 7.25 mm. Similarly, segment 544 has a length of 12.20 mm as compared to segment 556 which has a shorter length of 9.70 mm.

In operation, antenna 500 is a multi-band antenna radiating in the 824-960 MHz low-band range, and 1710-1990 MHz high-band range. Similar to antennas 300 and 400 described above, antenna 500 is positioned on backing 504 and placed in meter 100 such that the low-band arms radiate above meter housing 104. In general, the bends and loops of high-band arms 524 and 526 of antenna 500 decrease the peak gain of this band by approximately 1.5 to 2 dBi without sacrificing RF performance (efficiency). The asymmetry of the high-band arms is used to accommodate varying electrical component densities of a PCB 106, such that the shorter, right high-band arm is adjacent an area of PCB 106 having a higher electrical component density as compared to the left high-band arm. Further, the overall compact shape of the high-band arms permits antenna 500 may be useful to avoid projecting the high-band arms into areas that generate particularly high RF interference, or that have limited space.

Figure 18:
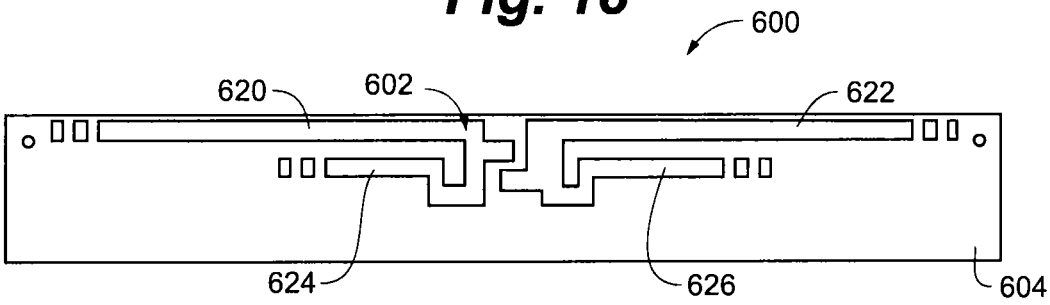
FIG. 18 is a front view of another embodiment of an antenna of the present invention.
Figure 19:
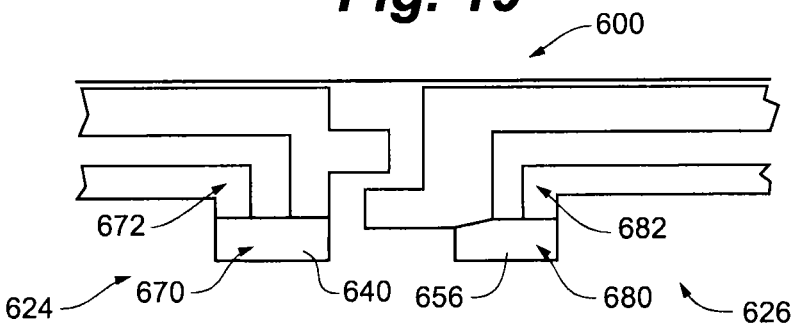
FIG. 19 is a partial front view of the antenna of FIG. 18.

Referring to FIGS. 18 and 19, another embodiment of an optimized conformal antenna, antenna 600, is depicted. Antenna 600 includes trace 602 and backing 604. Antenna trace 602 includes left low-band arm 620, right low-band arm 622, left high-band arm 624, and right high-band arm 626.

Low-band arms 620 and 622 are substantially similar to low band arms 520 and 522 described above with respect to antenna 500.

High-band arms 624 and 626 of antenna 600 include fewer loops, bends and segments as compared to high-band arms 524 and 526 of antenna 500. High-band arm 624 includes loop 670 and bend 672; high-band arm 626 includes loop 680 and bend 682. In one embodiment, horizontal segment 640 of loop 670 is somewhat longer than corresponding horizontal segment 656 of loop 680, such that high-band arms 624 and 626 are asymmetrical with respect to each other.

Antenna 600 operates in the 824-960 MHz low-band range, and 1710-1990 MHz high-band range. The particular geometry of high-band arms 624 and 626 are well-suited to work adjacent to circular PCBs 106 having slightly different component densities as compared to other PCBs 106 that may be used with antenna 500.

Figure 20:
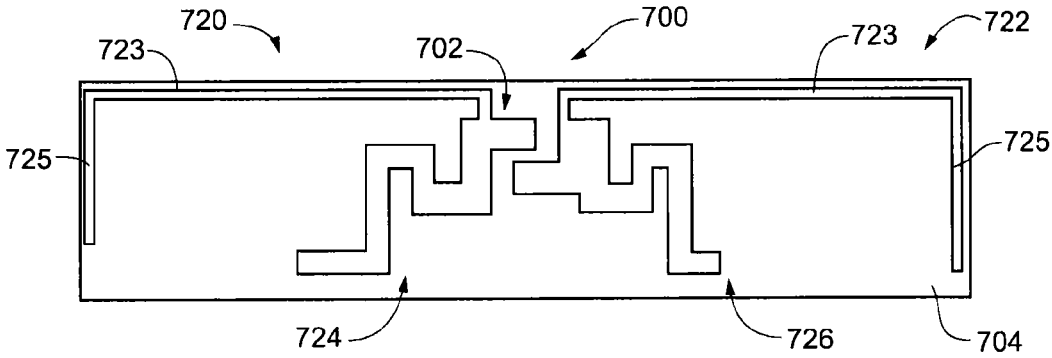
FIG. 20 is a front view of an embodiment of an antenna of the present invention.
Figure 21:
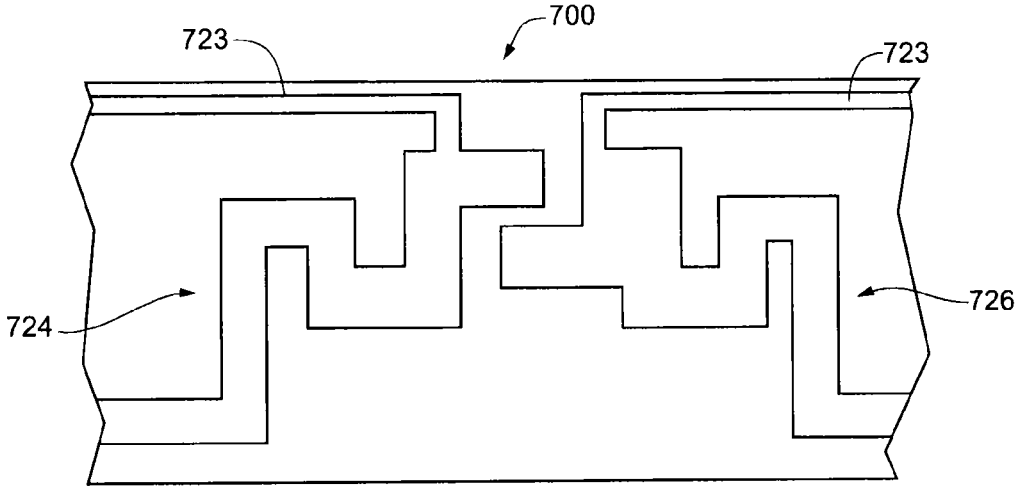
FIG. 21 is a partial front view of the antenna of FIG. 20.

Referring to FIGS. 20 and 21, another asymmetric dual-dipole antenna of the present invention is depicted. Antenna 700 includes antenna trace 702 and backing 704. Trace 702 includes left low-band arm 720, right low-band arm 722, left high-band arm 724, and right high-band arm 726.

In this embodiment, high-band arms 724 and 726 are substantially the same as high-band arms 524 and 526 of antenna 500. However, low-band arms 720 and 722 differ from the low-band arms of antennas 500 and 600, described above. Antenna 700 and backing 704 are shorter in length as compared to antenna 500 in the embodiment depicted in FIGS. 16 and 17. Therefore, the horizontal lengths of low-band arms 720 and 722 are restricted. To make up for the decreased horizontal space and to keep the effective horizontal electrical length relatively similar to those of antenna 500, the trace width of low-band arms 720 is relatively narrow, and each low-band arm 720 and 722 comprise a single horizontal segment 723 and a single vertical segment 725. In one embodiment, the width of low-band arms is approximately 25 to 40% the width of high-band arms 424 and 426. If the low band arms 720 and 722 were not made sleeker than the vertical segments of the low band arms 725 along the edges, the antenna would be much longer, which would affect the performance of the antenna adversely due to exposure to adjacent high density component areas or other conductive materials of meter 100.

Because housing 104 and PCB 106 are located adjacent antenna 700, and in particular, high-band arms 724 and 726, PCB 106 and its components couple with antenna 700, affecting its operation. If high-band arms 724 and 726 did not include bends and loops, and rather consisted of straight traces, then this would create "electromagnetic hot" regions along the length of the trace, causing relatively high peak gains at those locations.

Operation in the high-band range is further improved through the asymmetry of high-band arm 724 and high-band arm 726.

Other antennas of the present invention may utilize similar asymmetric dual-dipole concepts of placing the low-band arms above the high-band arms, including bends in asymmetric high-band arms, and locating the antenna such that the low-band arms look into free space, while the high-band arms are adjacent the top of a meter body. Several such variations and embodiments are depicted in other figures shown in the embodiment.

Figure 22A:
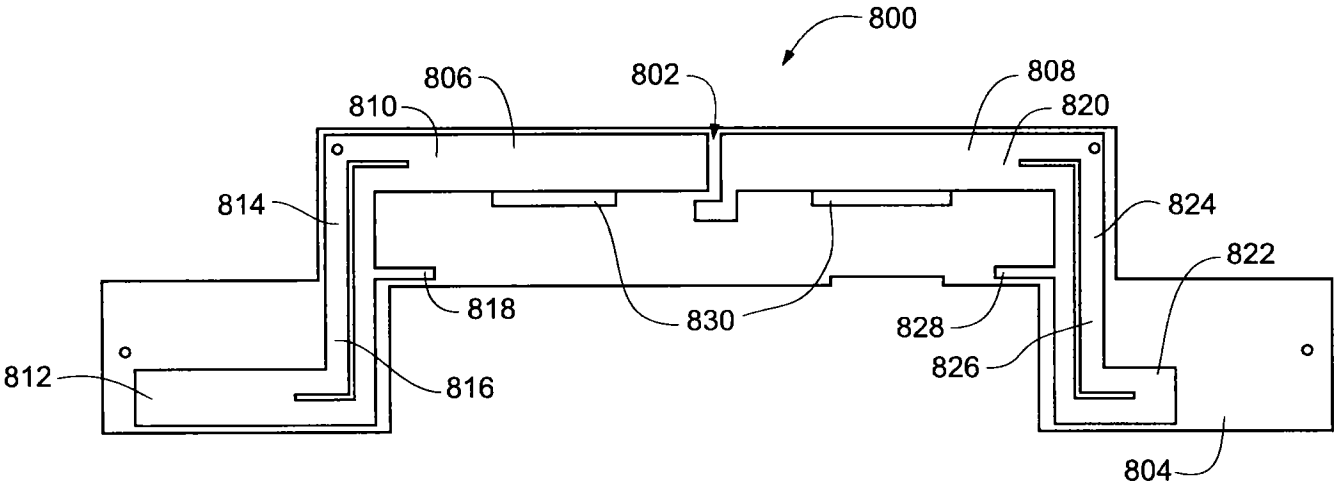
FIG. 22*a* is a front view of an embodiment of a single, low-band antenna of the present invention.
Figure 22B:
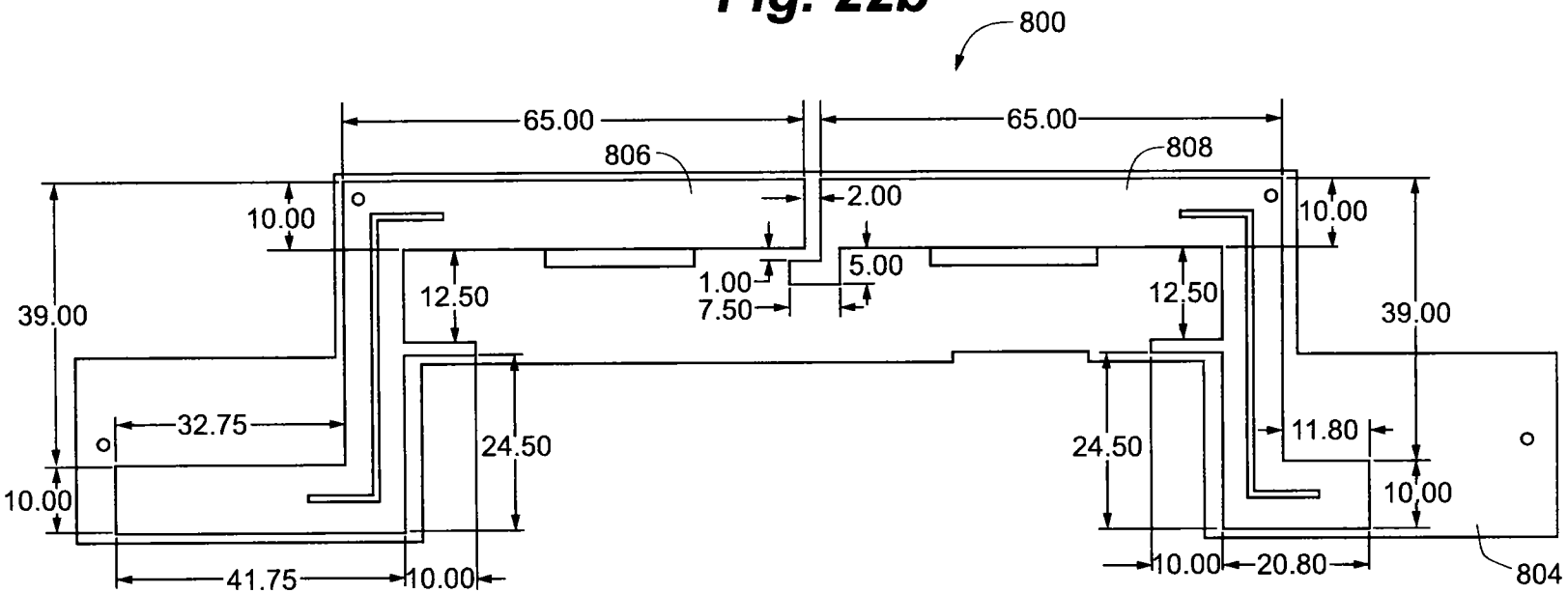
FIG. 22*b* is a front view of an embodiment of the antenna of FIG. 22*a*, including dimensions.
Figure 22C:
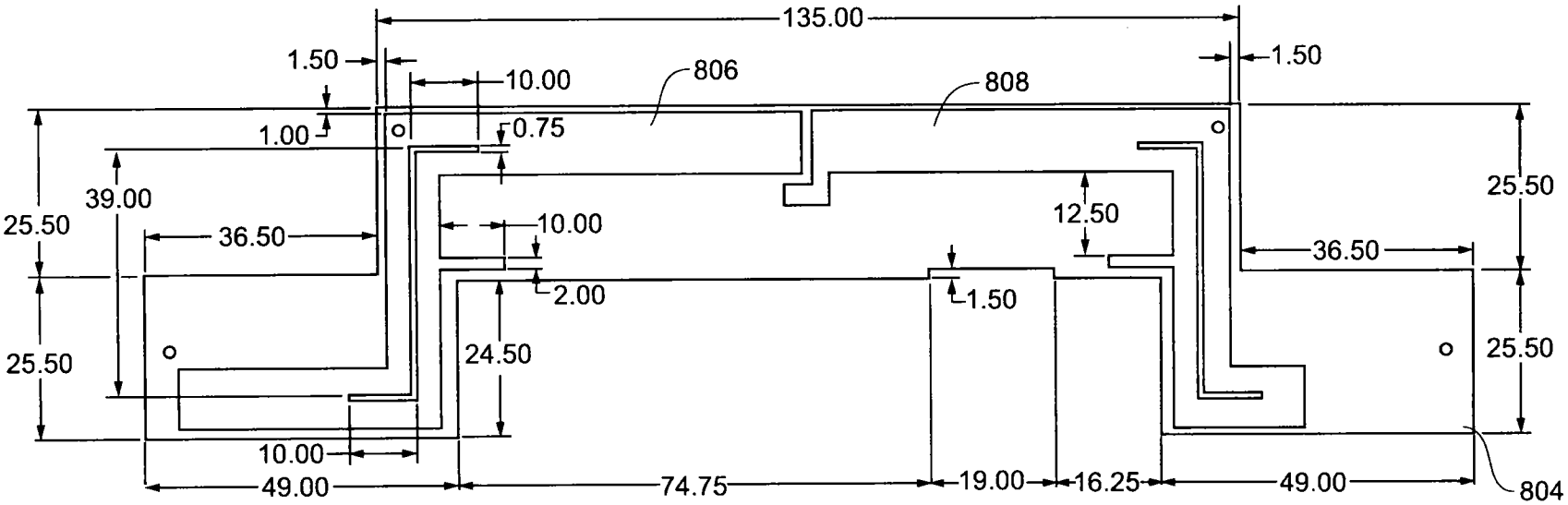
FIG. 22*c* is a front view of an embodiment of the antenna of FIG. 22*a*, including additional dimensions.

Referring to FIGS. 22*a*-22*c*, a single-band, low-band antenna 800 operational in the 450-470 MHz range is depicted. Antenna 800 comprises trace 802 and backing 804. Trace 802 includes multi-segmented left arm 806 and multi-segmented right arm 808.

Left arm 806 includes two larger horizontal segments 810 and 812 connected by a split vertical segment 814. Slot 816 divides vertical segment 814 and penetrates portions of horizontal segments 810 and 812. Left arm 806 also includes a smaller horizontal segment 818 extending away from vertical segment 814 towards a center of antenna 800.

Right arm 808 includes two larger horizontal segments 820 and 822 connected by a split vertical segment 824. Slot 826 divides vertical segment 824 and penetrates portions of horizontal segments 820 and 822. Right arm 808 also includes a smaller horizontal segment 828 extending away from vertical segment 824 towards a center of antenna 800.

Although antenna 800 is designed for low-band operation, it also benefits also from the asymmetrical design of trace 802, which in the embodiment depicted includes segment 822 being shorter than segment 812.

Backing 804 is shaped to generally follow the pattern of trace 802 and to mount to a housing 104, and may include positional indicators 830 used to align antenna 800 with a top surface 118 of a housing 104.

Left arm 806 and right arm 808 are asymmetric so as to match asymmetry of the loading of meter 100, as described above with respect to the other antenna embodiments. As compared to the low-band arms of the above-described multi-band antennas, antenna arms 806 and 808 are generally wider and include a pair of 90 degree bends. These structural features help in achieving optimal voltage standing wave ratio (VSWR), which in the embodiment depicted is typically less than 2:1.

Slots 818 and 826, along with segments 818 and 828 improve performance by increasing the impedance and VSWR bandwidth of the antenna. These features, combined with a position of the antenna above a top surface of housing 104 helps in achieving optimal overall antenna radiation efficiency.

In the depicted embodiment, antenna 800 does not include a balun.

Figure 23A:
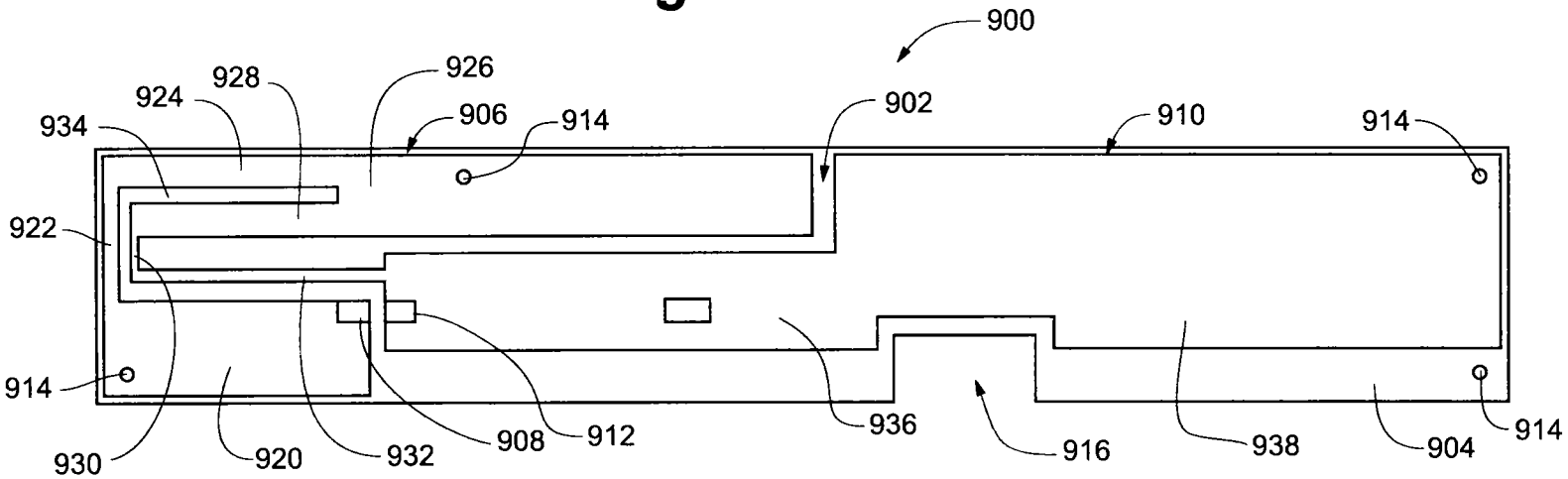
FIG. 23*a* is a front view of another embodiment of a single, low-band antenna of the present invention.
Figure 23B:
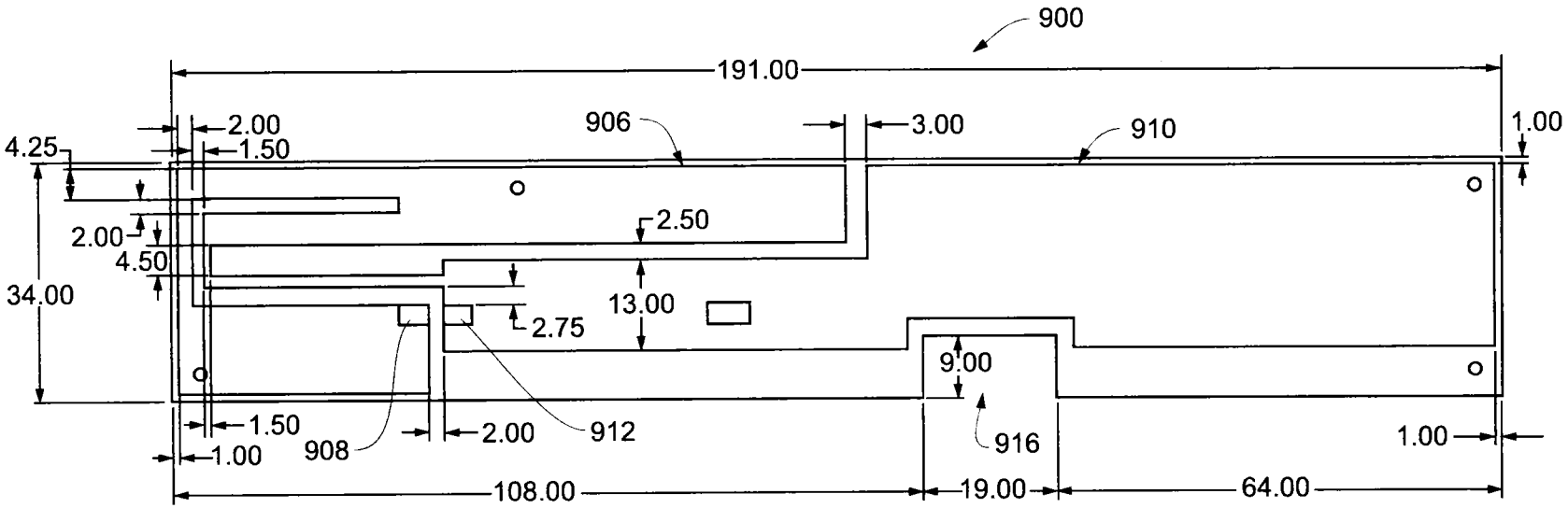
FIG. 23*b* is a front view of an embodiment of the antenna of FIG. 23*a*, including dimensions.
Figure 23C:
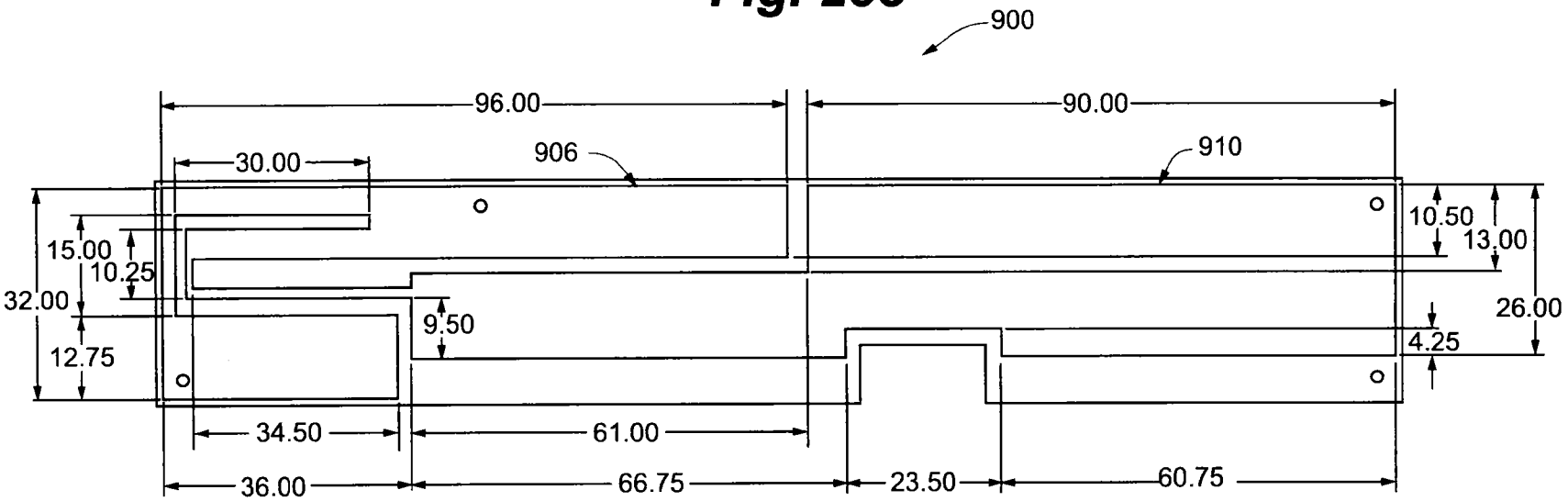
FIG. 23*c* is a front view of an embodiment of the antenna of FIG. 23*a*, including additional dimensions.

Referring to FIGS. 23*a*-23*c*, another embodiment of an asymmetric low-band antenna, antenna 900, is depicted. Antenna 900 is optimized for operation in the 450-470 MHz range. Antenna 900 includes antenna trace 902 and backing 904. Trace 902 includes left portion 906 with signal pad 908, and right portion 910 with ground pad 912.

Left portion 906 includes horizontal segment 920, vertical segment 922, horizontal segments 924, 926, 928, vertical segment 930, and horizontal segment 932. Signal pad 908 is located at horizontal segment 920. Segments 920 to 932 are contiguous to form left portion 906. Segment 932 links left portion 906 to right portion 910 and ground pad 912. Left portion 906 defines slot 934.

Right portion 910 includes segments 936 and 938. Segments 934 and 936 are contiguous to form right portion 910.

Backing 904 is generally rectangular, and defines a plurality of mounting holes 914 and recess 916 for mounting to a meter housing 104.

Antenna is very sleek as compared to other known antennas optimized for 450 MHz operation. Antenna 900 when installed is positioned the upper part of meter 100 and so is away from all the high power devices or components that are in the bottom half of meter 100. In an embodiment, antenna 900 does not include a balun and is designed on a semi-IFA concept.

Antenna trace 902 has a loop-back feature such that left portion 906 having signal pad 908 connects to right portion 910, thereby connecting to the ground of the antenna. The loop-back feature is comprised of segments 928, 930 and 932. This loop back feature helps in achieving very good VSWR, but makes antenna 900 very narrow band. The narrow slot 934 between the antenna element traces and between the element trace and the ground traces helps in creating additional resonances, which when combined with the main antenna resonance, helps in broadening the VSWR or impedance bandwidth of antenna 900.

Although the present invention has been described with respect to the various embodiments, it will be understood that numerous insubstantial changes in configuration, arrangement or appearance of the elements of the present invention can be made without departing from the intended scope of the present invention. Accordingly, it is intended that the scope of the present invention be determined by the claims as set forth.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A dual-dipole, multi-band conformal antenna for facilitating optimized wireless communications of a utility meter, the antenna comprising:

an antenna backing, the backing adapted to conform to an inside surface of a utility meter; and an antenna trace affixed to the antenna backing, the antenna trace comprising a conductive material and including:

a low-band portion for radiating in a low-band frequency range and having a left low-band arm and a right low-band arm, the left low-band arm being substantially the same as the right low-band arm such that the low-band portion is substantially symmetrical about a central axis of the antenna trace; and a high-band portion for radiating in a high-band frequency range and having a left high-band arm having a left length and a right high-band arm having a right length, the left high-band arm and the right high-band arm being asymmetrical about the central axis of the antenna trace such that the right length of the right high-band arm is not substantially equal to the left length of the left high-band arm, the left length being the sum of lengths of all segments of the left high-band arm, and the right length being the sum of lengths of all segments of the right high-band arm;

wherein a left-side conductive area of the antenna trace is substantially equal to a right-side conductive area of the antenna trace.

2. The antenna of claim 1, wherein the right low-band arm and the left low-band arm each consist of a single, rectangular trace segment.

3. The antenna of claim 1, wherein the right high-band arm and the left high band arm each consist of a single, rectangular trace segment.

4. The antenna of claim 1, wherein a vertical distance between the right high-band arm and the right low-band arm is substantially the same as a vertical distance between the left high-band arm and the left low-band arm.

5. The antenna of claim 1, wherein the left high-band arm includes a first horizontal segment and a first vertical segment, and the right high band arm includes a first horizontal segment and a first vertical segment.

6. The antenna of claim 5, wherein the first horizontal segment of the left high-band arm is transverse to the first vertical segment of the left high-band arm, and the first horizontal segment of the right high-band arm is transverse to the first vertical segment of the right high-band arm.

7. The antenna of claim 5, wherein the left high-band arm further includes a second horizontal segment and a second vertical segment, and the right high-band arm includes a second horizontal segment and a second vertical segment.

* * * * *